US010553997B2

(12) United States Patent
Hashiguchi

(10) Patent No.: US 10,553,997 B2
(45) Date of Patent: Feb. 4, 2020

(54) CONNECTOR MATEABLE WITH A MATING CONNECTOR AND INCLUDING A CONTACT WITH A NARROW PORTION TO ACHIEVE A REDUCED CONTACT WIDTH

(71) Applicant: JAPAN AVIATION ELECTRONICS INDUSTRY, LIMITED, Shibuya-ku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/696,029

(22) Filed: Sep. 5, 2017

(65) Prior Publication Data

US 2018/0097320 A1 Apr. 5, 2018

(30) Foreign Application Priority Data

Oct. 5, 2016 (JP) ..... 2016-197129

(51) Int. Cl.
*H01R 24/60* (2011.01)
*H01R 13/24* (2006.01)
(Continued)

(52) U.S. Cl.
CPC ..... *H01R 24/60* (2013.01); *H01R 13/2492* (2013.01); *H01R 13/415* (2013.01); *H01R 2107/00* (2013.01)

(58) Field of Classification Search
CPC ..... H01R 12/737; H01R 24/60
(Continued)

(56) References Cited

U.S. PATENT DOCUMENTS 6,634,911 B1 * 10/2003 Billman ..... H01R 12/716 439/637
7,637,783 B2 * 12/2009 Sasaoka ..... H01R 43/16 439/637
(Continued)

FOREIGN PATENT DOCUMENTS

JP 3117439 B1 12/2000
JP 2009199766 A 9/2009
(Continued)

OTHER PUBLICATIONS

Chinese Office Action (and English language translation thereof) dated Feb. 1, 2019 issued in counterpart Chinese Application No. 201710728964.1.
(Continued)

*Primary Examiner* — Tulsidas C Patel
*Assistant Examiner* — Marcus E Harcum
(74) *Attorney, Agent, or Firm* — Holtz, Holtz & Volek PC

(57) ABSTRACT

A connector is mateable with a mating connector along a front-rear direction. The connector comprises at least one contact and a holding member. The at least one contact has a first support portion, a second support portion, a first contact portion, a second contact portion and a coupling portion. The first support portion has a first edge in a width direction. The coupling portion has an upper main portion and an upper bent portion. The upper main portion has an upper front wide portion, an upper front narrow portion and an upper base portion. The upper front narrow portion has an edge facing a first orientation. The at least one contact has a first boundary portion between the first edge of the first support portion and the upper front wide portion in the front-rear direction. The edge of the upper front narrow portion is positioned beyond the first boundary portion in a second orientation.

6 Claims, 15 Drawing Sheets

(51) Int. Cl.
*H01R 13/415* (2006.01)
*H01R 107/00* (2006.01)

(58) Field of Classification Search
USPC ..... 439/862, 856
See application file for complete search history.

(56) References Cited

U.S. PATENT DOCUMENTS

| | | | | |
|---|---|---|---|---|
| 7,988,500 | B2 * | 8/2011 | Furukawa | H01R 13/41 439/66 |
| 8,672,713 | B2 * | 3/2014 | Tajiri | H01R 12/585 439/630 |
| 9,065,225 | B2 * | 6/2015 | Degner | H01R 12/721 |
| 9,196,986 | B2 * | 11/2015 | Tanaka | H01R 12/737 |
| 9,608,349 | B2 * | 3/2017 | Mashiyama | H01R 12/716 |
| 9,966,679 | B2 * | 5/2018 | Xu | H01R 12/523 |

FOREIGN PATENT DOCUMENTS

| | | | |
|---|---|---|---|
| JP | 5288851 | B2 | 9/2013 |
| JP | 2016110966 | A | 6/2016 |

OTHER PUBLICATIONS

Chinese Office Action dated Jul. 17, 2019 (and English language translation thereof) issued in counterpart Chinese Application No. 201710728964.1.

* cited by examiner

CONNECTOR MATEABLE WITH A MATING CONNECTOR AND INCLUDING A CONTACT WITH A NARROW PORTION TO ACHIEVE A REDUCED CONTACT WIDTH

CROSS REFERENCE TO RELATED APPLICATIONS

This application is based on and claims priority under 35 U.S.C. § 119 to Japanese Patent Application No. JP2016-197129 filed Oct. 5, 2016, the contents of which are incorporated herein in their entirety by reference.

BACKGROUND OF THE INVENTION

This invention relates to a connector comprising a contact which enables the connector to have a reduced size in a width direction.

As shown in FIG. 27, JP-A 2016-110966 (Patent Document 1) discloses a connector 900 which is mateable with a mating connector (not shown) along a mating direction, or along an X-direction. The connector 900 comprises a plurality of contacts 910 and a holding member 950. Each of the contacts 910 is held by the holding member 950. As shown in FIGS. 28 and 29, each of the contacts 910 comprises a first contact piece 920, a second contact piece 930, a first contact portion 922, a second contact portion 932 and a coupling portion 940. The first contact piece 920 and the second contact piece 930 are arranged in an up-down direction, or in a Z-direction. The first contact portion 922 is provided in the vicinity of a free end of the first contact piece 920. The second contact portion 932 is provided in the vicinity of a free end of the second contact piece 930. The coupling portion 940 has two side walls 942, 944, two bent portions 943, 945 and a wall portion 946. The bent portion 943 extends from an end of the side wall 942 in a width direction, or in a Y-direction, and is bent in the Z-direction. The bent portion 945 extends from an end of the side wall 944 in the width direction and is bent in the Z-direction. The bent portions 943, 945 are coupled with each other by the wall portion 946. The first contact piece 920 extends from the side wall 942 in the mating direction, or in the X-direction. The second contact piece 930 extends from the side wall 944 in the mating direction, or in the X-direction.

A size of the contact 910 of Patent Document 1 in the width direction depends on a size of the coupling portion 940 in the width direction. In addition, a size of each of the first contact piece 920 and the second contact piece 930 in the width direction depends on the size of the coupling portion 940 in the width direction. Accordingly, the connector 900, which comprises the contacts 910, cannot have a reduced size in the width direction while each of the first contact piece 920 and the second contact piece 930 has an increased size in the width direction.

SUMMARY OF THE INVENTION

It is therefore an object of the present invention to provide a connector comprising a contact which enables the connector to have a reduced size in a width direction.

One aspect of the present invention provides a connector mateable with a mating connector along a front-rear direction. The connector comprises at least one contact and a holding member. The holding member holds the at least one contact. The at least one contact has a first support portion, a second support portion, a first contact portion, a second contact portion and a coupling portion. Each of the first support portion and the second support portion is resiliently deformable. The first contact portion is supported by the first support portion. The second contact portion is supported by the second support portion. Each of the first contact portion and the second contact portion is movable in an up-down direction perpendicular to the front-rear direction. The first support portion has a first edge and a second edge in a width direction perpendicular to both the front-rear direction and the up-down direction. The first edge faces a first orientation of the width direction. The second edge faces a second orientation of the width direction. The first orientation and the second orientation are opposite to each other in the width direction. The coupling portion couples the first support portion and the second support portion with each other. The coupling portion has an upper main portion and an upper bent portion. The upper main portion has an upper front wide portion, an upper front narrow portion and an upper base portion. The upper front wide portion is fixed to the holding member so as to be immovable in the width direction. The first support portion extends forward from the upper front wide portion in the front-rear direction. The upper front narrow portion is positioned between the upper front wide portion and the upper base portion in the front-rear direction. The upper front narrow portion has an edge facing the first orientation. The at least one contact has a first boundary portion between the first edge of the first support portion and the upper front wide portion in the front-rear direction. The edge of the upper front narrow portion is positioned beyond the first boundary portion in the second orientation. The upper base portion has an edge facing the first orientation. The upper bent portion extends from the edge of the upper base portion and is bent downward.

In the contact of the connector of the present invention, the edge, which faces the first orientation, of the upper front narrow portion is positioned in the second orientation beyond the first boundary portion between the first edge of the first support portion and the upper front wide portion. In addition, the upper bent portion extends from the edge, which faces the first orientation, of the upper base portion and is bent downward. Accordingly, as compared with the contact of Patent Document 1, the contact as a whole can have a reduced size in the width direction while a base of the first support portion has an increased size in the width direction. Thus, the connector can have a reduced size in the width direction.

Figure 1:
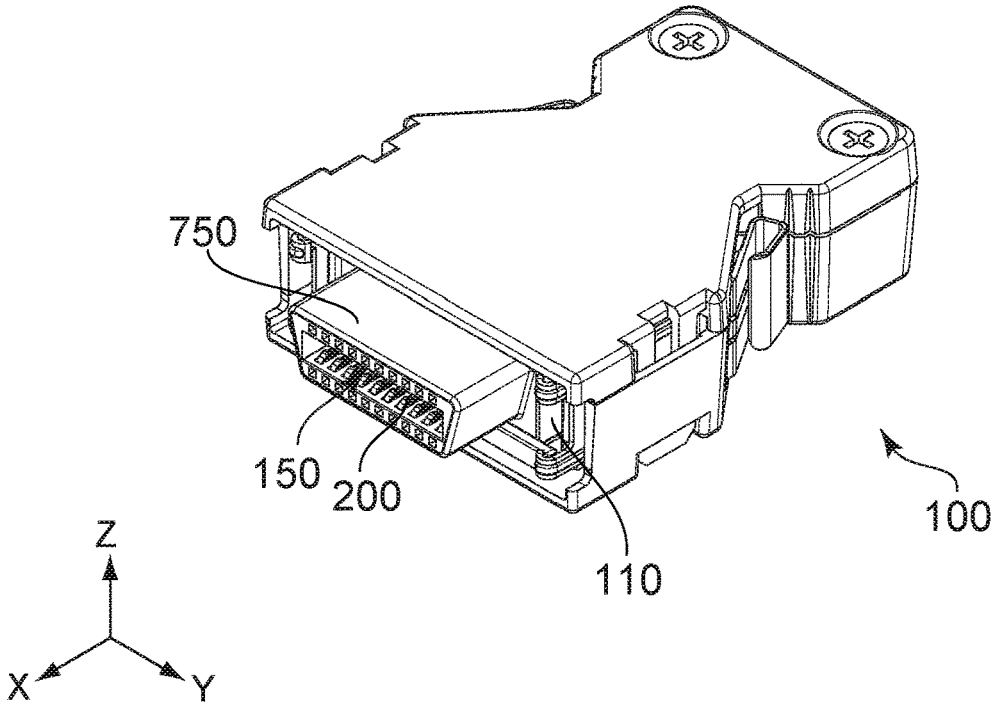
FIG. 1 is an upper perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 5:
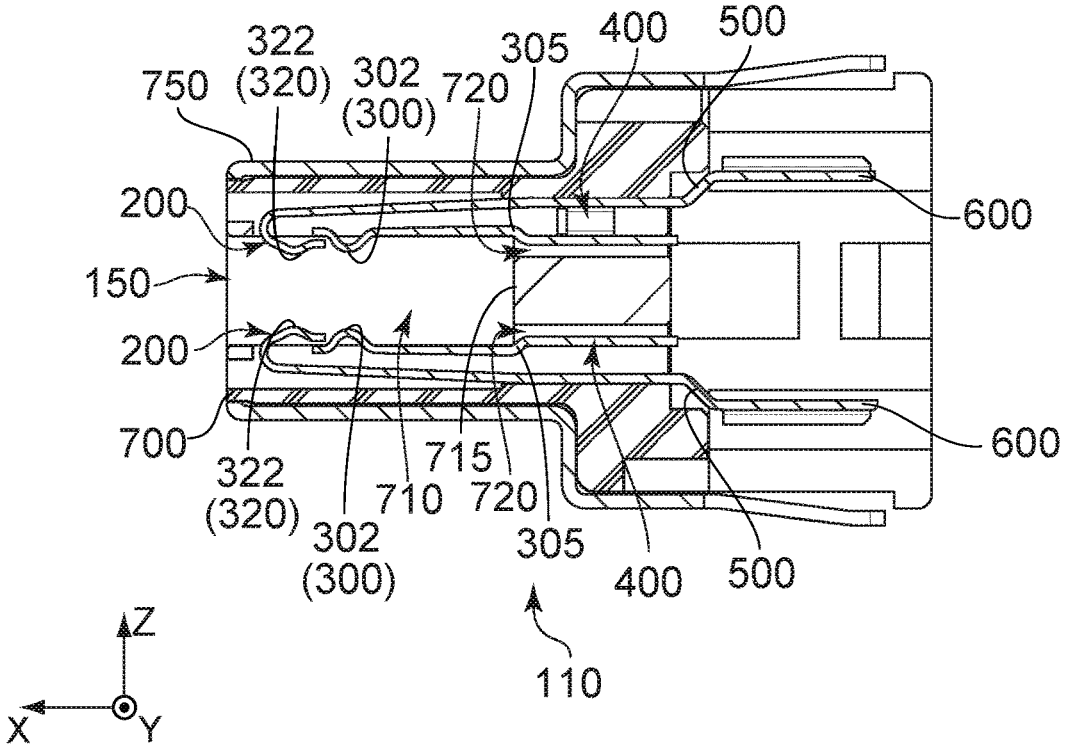
FIG. 5 is a cross-sectional view showing the connector body of FIG. 3, taken along line B-B.
Figure 26:
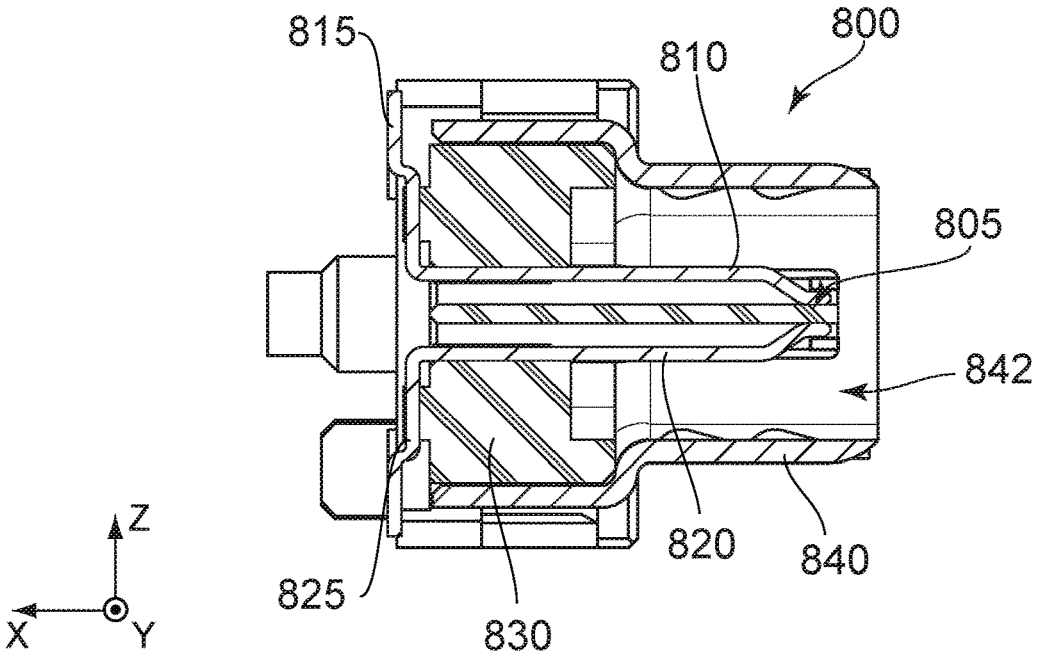
FIG. 26 is a cross-sectional view showing a mating connector according to an embodiment of the present invention.
Figure 27:
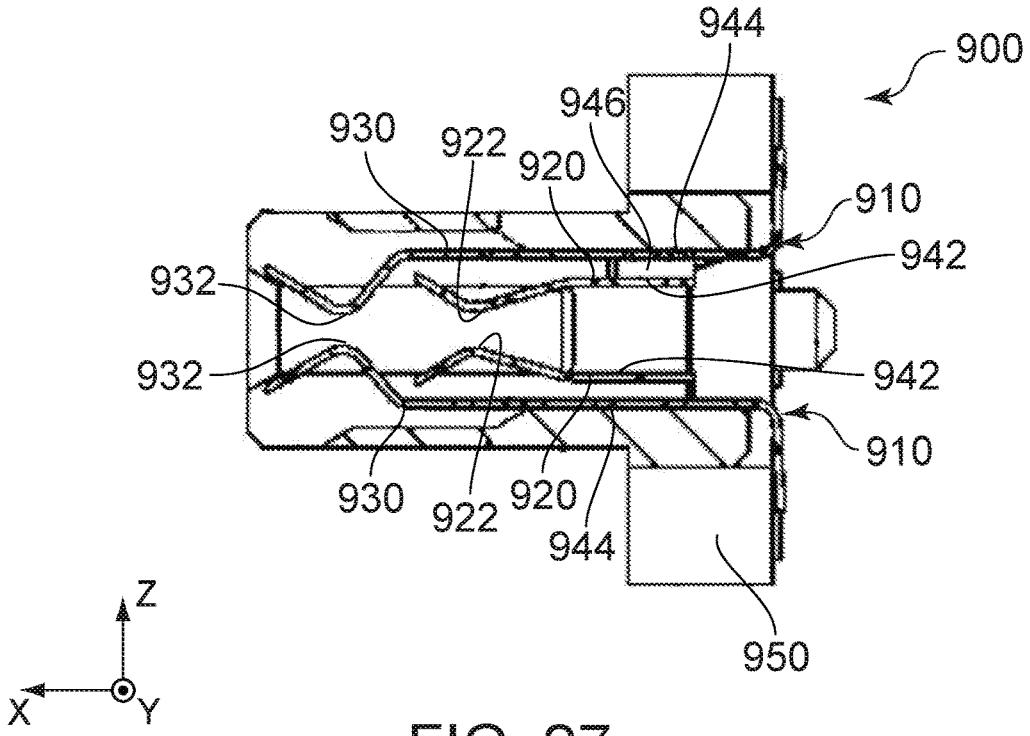
FIG. 27 PRIOR ART
FIG. 27 is a cross-sectional view showing a connector of Patent Document 1.
Figure 28:
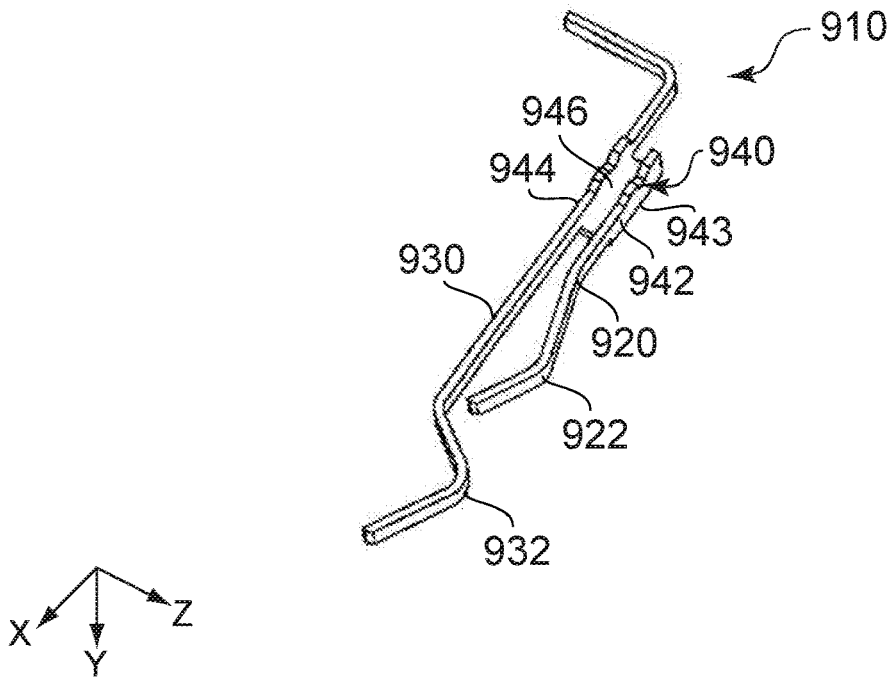
FIG. 28 PRIOR ART
FIG. 28 is an upper perspective view showing a contact which is included in the connector of FIG. 27.
Figure 29:
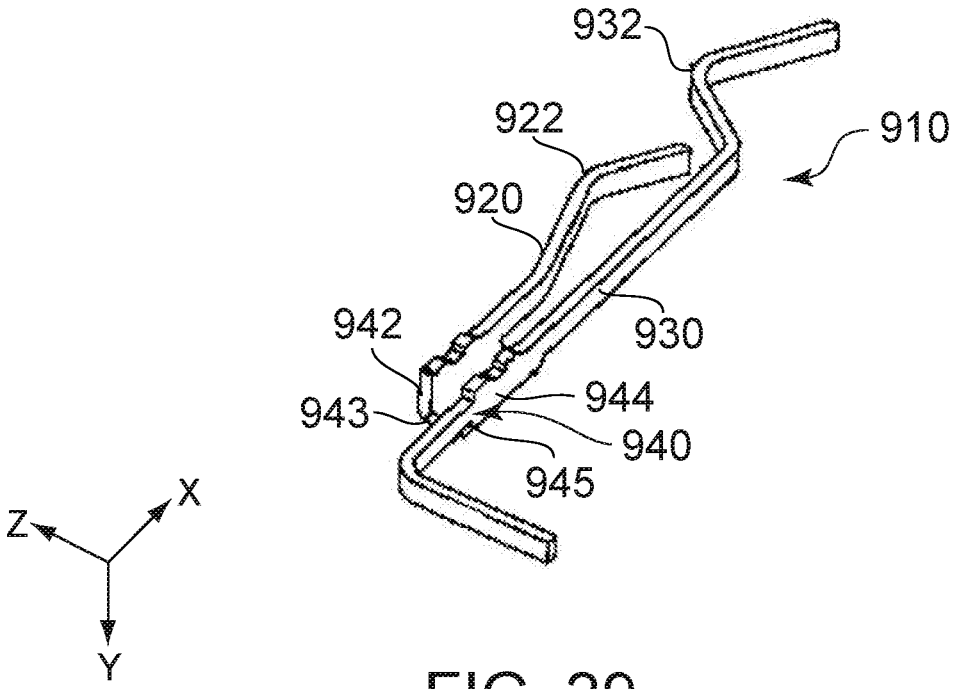
FIG. 29 PRIOR ART
FIG. 29 is another upper perspective view showing the contact of FIG. 28.

As shown in FIGS. 1, 5 and 26, a connector 100 according to a first embodiment of the present invention is mateable with a mating connector 800 along a front-rear direction. In the present embodiment, the front-rear direction is an X-direction. Specifically, it is assumed that forward is a positive X-direction while rearward is a negative X-direction.

As understood from FIG. 26, the mating connector 800 of an embodiment of the present invention has a plurality of mating upper contacts 810, a plurality of mating lower contacts 820, a mating holding member 830 and a mating shell 840. The mating holding member 830 has a plate portion 805. The mating holding member 830 holds the mating upper contacts 810 and the mating lower contacts 820. Each of the mating upper contacts 810 is provided on an upper surface of the plate portion 805. Each of the mating upper contacts 810 has an upper fixed portion 815 which extends upward from a front end of the mating holding member 830. Each of the mating lower contacts 820 is provided on a lower surface of the plate portion 805. Each of the mating lower contacts 820 has a lower fixed portion 825 which extends downward from the front end of the mating holding member 830. Each of the upper fixed portion 815 and the lower fixed portion 825 is fixed to a circuit board (not shown). In the present embodiment, an up-down direction is a Z-direction. Specifically, upward is a positive Z-direction, and downward is a negative Z-direction. The mating shell 840 partly covers the mating holding member 830 and forms a mating fitting portion 842.

Figure 2:
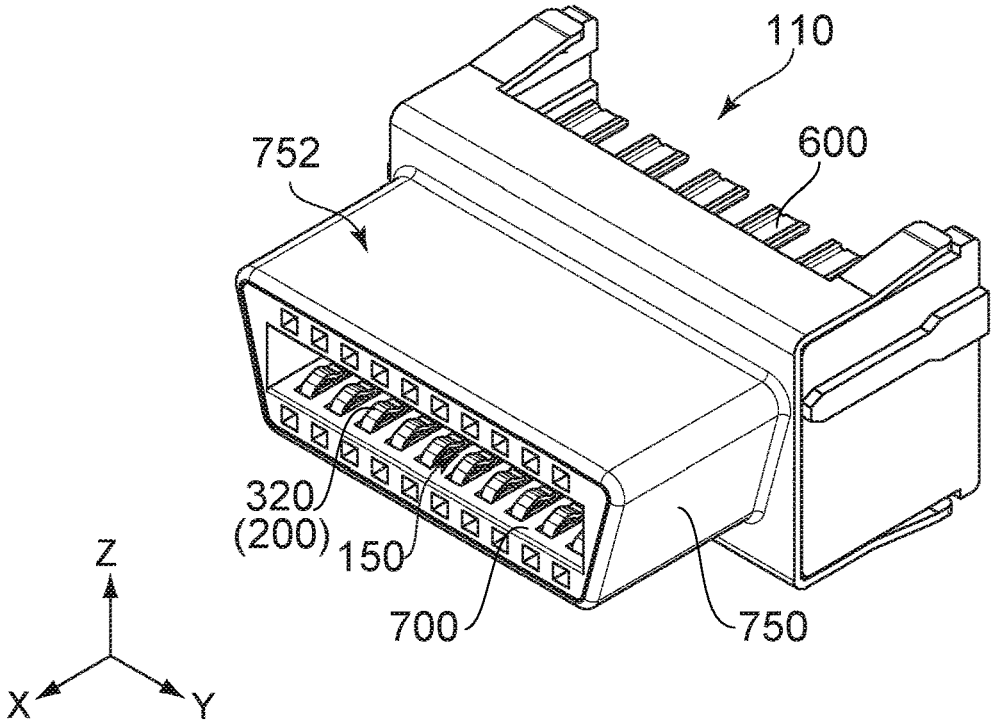
FIG. 2 is an upper perspective view showing a connector body which is included in the connector of FIG. 1.
Figure 3:
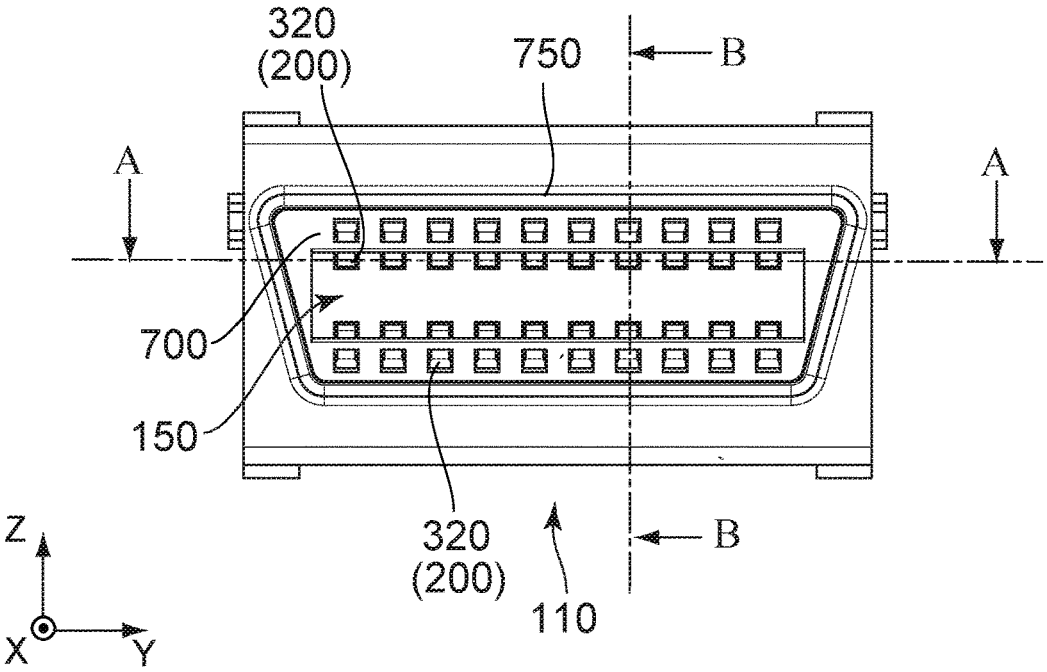
FIG. 3 is a front view showing the connector body of FIG. 2.

As shown in FIGS. 1 and 2, the connector 100 according to the present embodiment comprises a connector body 110 which is positioned at a front of the connector 100 in the front-rear direction.

As shown in FIGS. 2 to 5, the connector body 110 comprises an opening 150, a holding member 700, a plurality of contacts 200 and a shell 750. The holding member 700 is made of insulator. Each of the contacts 200 is made of conductor. The shell 750 is made of metal. The shell 750 partially covers the holding member 700. A front end of the shell 750 forms a fitting portion 752.

As shown in FIGS. 2 to 5, the opening 150 of the present embodiment is opened at a front of the connector body 110 in the front-rear direction.

Figure 4:
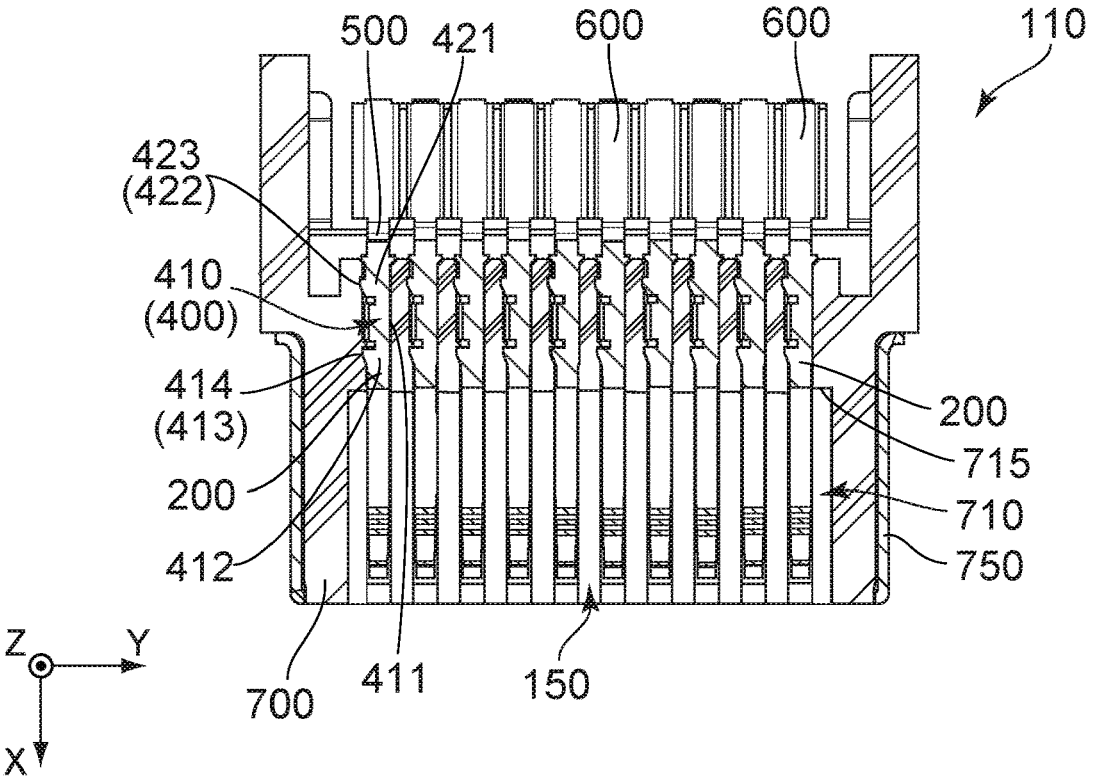
FIG. 4 is a cross-sectional view showing the connector body of FIG. 3, taken along line A-A.

As shown in FIGS. 4 and 5, the holding member 700 of the present embodiment has a receiving portion 710 and a plurality of contact holding portions 720. The receiving portion 710 receives the plate portion 805 of the mating connector 800 when the connector 100 and the mating connector 800 are mated with each other. The receiving portion 710 has a rear wall 715 which is positioned rearwardly away from the opening 150 in the front-rear direction. In detail, as understood from FIGS. 2, 5 and 26, when the connector 100 is mated with the mating connector 800, the fitting portion 752 is received in the mating fitting portion 842 while the plate portion 805 is received in the receiving portion 710 through the opening 150. Referring to FIGS. 4 and 5 again, the contact holding portions 720 hold the contacts 200, respectively. Each of the contact holding portions 720 is a hole which pierces the holding member 700 in the front-rear direction. Each of the contact holding portions 720 has two inner walls which face each other in a width direction perpendicular to both the front-rear direction and the up-down direction. In the present embodiment, the width direction is a Y-direction.

As shown in FIGS. 6 to 9, each of the contacts 200 has a first support portion 300, a first contact portion 302, a second support portion 320, a second contact portion 322, a coupling portion 400, an upper rear narrow portion 419, an upper rear wide portion 421, a lower rear narrow portion 479, a lower rear wide portion 481, a connecting portion 500 and a fixed portion 600.

As shown in FIGS. 6 to 9, the first support portion 300 has a slope portion 305, a first plate portion 307 and a bulge portion 308. The slope portion 305 is positioned at a rear end of the first support portion 300 in the front-rear direction. The slope portion 305 slopes forward and downward. The first plate portion 307 has a plate-like shape intersecting with the up-down direction. The first plate portion 307 extends forward from a front end of the slope portion 305. The bulge portion 308 extends forward and upward from a front end of the first plate portion 307 and then extends forward and downward. Specifically, a front end of the bulge portion 308 is a free end. More specifically, the bulge portion 308 has a substantially semicircular shape in a plane perpendicular to the width direction. The first contact portion 302 is positioned at an upper end of the bulge portion 308.

As shown in FIGS. 6 to 9, the first support portion 300 has a first edge 303 and a second edge 304 in the width direction. Each of the first edge 303 and the second edge 304 is a surface perpendicular to the width direction. The first edge 303 faces a first orientation of the width direction. The second edge 304 faces a second orientation of the width direction. In the present embodiment, the first orientation is a positive Y-direction while the second orientation is a negative Y-direction. In other words, the first orientation and the second orientation are opposite to each other.

As understood from FIGS. 2, 3, 5 and 6, the first support portion 300 is resiliently deformable. The first contact portion 302 is positioned in the vicinity of the free end of the bulge portion 308 of the first support portion 300. The first contact portion 302 is supported by the first support portion 300. Accordingly, the first contact portion 302 is movable in the up-down direction. More specifically, the first contact portion 302 of the first support portion 300 of the contact 200 shown in each of FIGS. 6 to 10 faces upward in the up-down direction and is movable downward.

As shown in FIGS. 6 to 9, the first support portion 300 has a size in the width direction and another size in the up-down direction, and the size of the first support portion 300 in the width direction is greater that the size of the first support portion 300 in the up-down direction. More specifically, the first plate portion 307 of the first support portion 300 has a size in the width direction and another size in the up-down direction, and the size of the first plate portion 307 in the width direction is greater that the size of the first plate portion 307 in the up-down direction.

As shown in FIGS. 6 to 9, the second support portion 320 has a second plate portion 327 and a folded back portion 328. The second plate portion 327 has a plate-like shape intersecting with the up-down direction. The folded back portion 328 extends forward and upward from a front end of the second plate portion 327 and is then folded back so as to have a curved shape. An end of the folded back portion 328 is a free end. Specifically, the folded back portion 328 has a substantially U-shape in the plane perpendicular to the width direction. The second contact portion 322 is positioned at an upper end of the folded back portion 328.

As shown in FIGS. 6 to 9, the second support portion 320 has a size in the width direction and another size in the up-down direction, and the size of the second support portion 320 in the width direction is greater than the size of the second support portion 320 in the up-down direction. More specifically, the second plate portion 327 of the second support portion 320 has a size in the width direction and another size in the up-down direction, and the size of the second plate portion 327 in the width direction is greater than the size of the second plate portion 327 in the up-down direction. The second plate portion 327 of the second support portion 320 is positioned below the first support portion 300 in the up-down direction.

As understood from FIGS. 2, 3, 5 and 6, the second support portion 320 is resiliently deformable. The second contact portion 322 is positioned in the vicinity of the free end of the folded back portion 328 of the second support portion 320. The second contact portion 322 is supported by the second support portion 320. Accordingly, the second contact portion 322 is movable in the up-down direction. More specifically, the second contact portion 322 of the second support portion 320 of the contact 200 shown in each of FIGS. 6 to 10 faces upward in the up-down direction and is movable downward.

As shown in FIGS. 6 to 9, the free end of the folded back portion 328 of the second support portion 320 is positioned above the free end of the bulge portion 308 of the first support portion 300 in the up-down direction. The free end of the bulge portion 308 of the first support portion 300 is positioned rearward of the folded back portion 328 of the second support portion 320, so that the free end of the bulge portion 308 of the first support portion 300 is guarded by the folded back portion 328. Accordingly, the first support portion 300 is prevented from being buckled by unintended force which is applied to the free end of the bulge portion 308 of the first support portion 300 from its front side.

As shown in FIGS. 6 to 9, the coupling portion 400 couples the first support portion 300 and the second support portion 320 with each other in the up-down direction. The coupling portion 400 has an upper main portion 410, an upper bent portion 440, a lower main portion 470, a lower bent portion 460 and a wall portion 450.

As shown in FIGS. 6 to 9, the upper main portion 410 has a plate-like shape perpendicular to the up-down direction. The upper main portion 410 has an edge 411 facing the second orientation, and the edge 411 has a linear shape. The upper main portion 410 has an upper front wide portion 412, an upper front narrow portion 415 and an upper base portion 417.

As shown in FIGS. 6 to 9, a front end of the upper front wide portion 412 forms a front end of the upper main portion 410. The upper front wide portion 412 has a press-fit protrusion 413 which protrudes in the first orientation of the width direction. As understood from FIGS. 4 and 6, the upper front wide portion 412 is fixed to the holding member 700 so as to be immovable in the width direction. A specific method of fixing the upper front wide portion 412 to the holding member 700 will be described later. In the upper front wide portion 412, an end of the press-fit protrusion 413 in the width direction is an end portion 414 facing the first orientation.

As shown in FIGS. 6 to 9, the first support portion 300 extends forward from the upper front wide portion 412 in the front-rear direction. More specifically, the slope portion 305 of the first support portion 300 extends forward and downward from the front end of the upper front wide portion 412.

As shown in FIGS. 6 to 9, the upper front narrow portion 415 is positioned between the upper front wide portion 412 and the upper base portion 417 in the front-rear direction. More specifically, in the front-rear direction, the upper front narrow portion 415 is positioned rearward of the upper front wide portion 412 and forward of the upper base portion 417. In the width direction, the upper front narrow portion 415 has a size smaller than a size of the upper front wide portion 412. Since the upper front wide portion 412 is fixed to the holding member 700 as described above, stress, which arises when the first support portion 300 is resiliently deformed in the up-down direction, is concentrated on a first boundary portion 306 between the first edge 303 of the first support portion 300 and the upper front wide portion 412 in the front-rear direction. Accordingly, the stress can be prevented from being concentrated on the upper front narrow portion 415 having a reduced size in the width direction.

Figure 6:
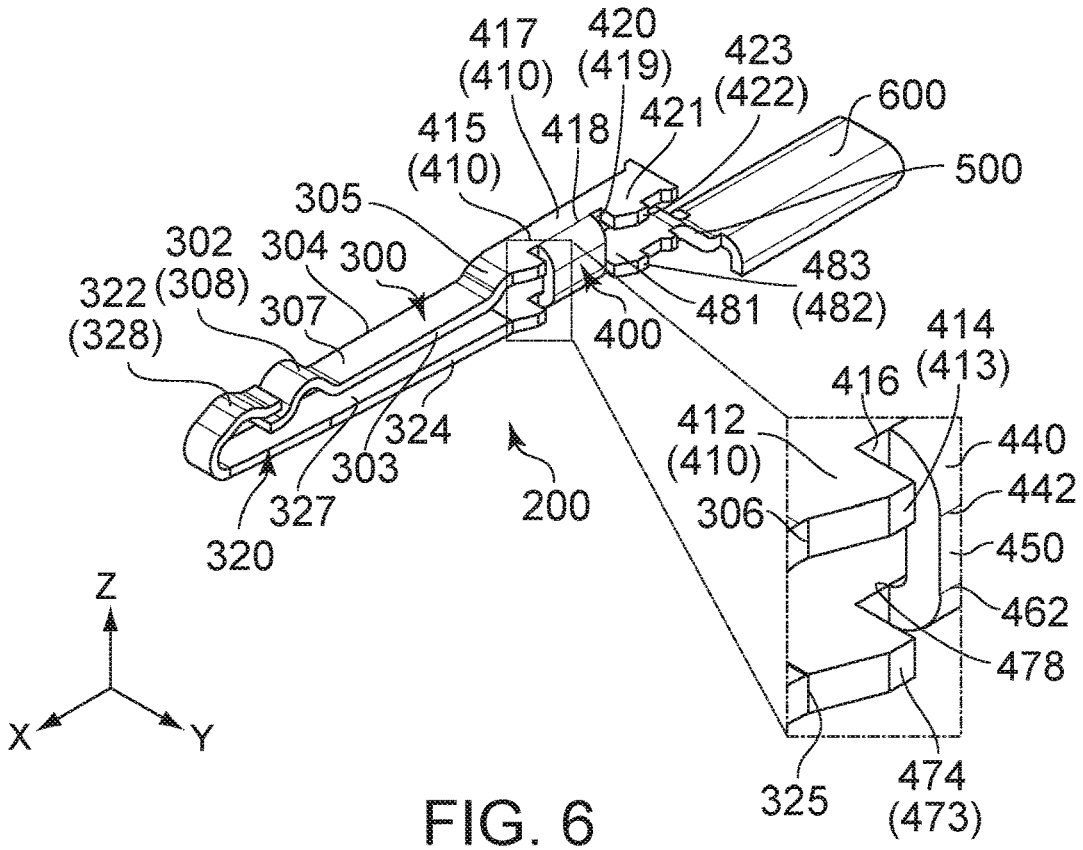
FIG. 6 is an upper perspective view showing a contact which is included in the connector body of FIG. 3, wherein a part of the contact is illustrated enlarged.
Figure 8:
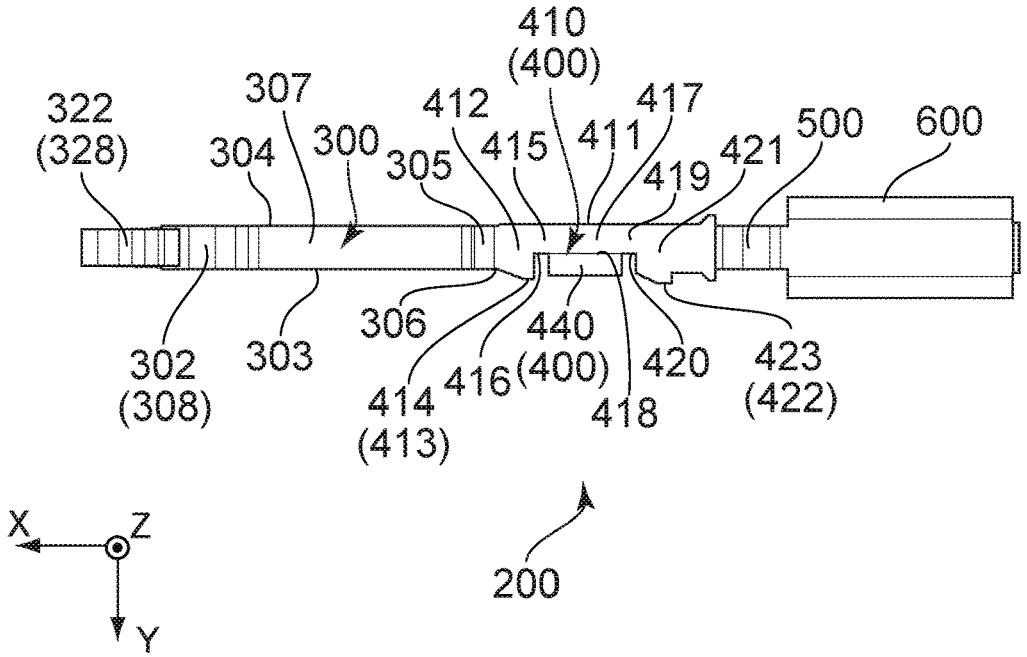
FIG. 8 is a top view showing the contact of FIG. 6.

As shown in FIGS. 6 and 8, the upper front narrow portion 415 has an edge 416 facing the first orientation, and the edge 416 is positioned beyond the first boundary portion 306 in the second orientation. Accordingly, the contact 200 as a whole can have a reduced size in the width direction while a base of the first support portion 300 has an increased size in the width direction.

As shown in FIGS. 6 to 9, the upper base portion 417 is positioned rearward of the upper front narrow portion 415 in the front-rear direction. The upper base portion 417 has a plate-like shape perpendicular to the up-down direction. The upper base portion 417 has an edge 418 facing the first orientation.

As shown in FIGS. 6 and 8, the upper bent portion 440 extends from the edge 418, which faces the first orientation, of the upper base portion 417 of the upper main portion 410, and is bent downward. Specifically, the upper bent portion 440 is bent downward while extending in the first orientation from the edge 418, which faces the first orientation, of the upper base portion 417. The end portion 414, which faces the first orientation, of the upper front wide portion 412, namely, the end of the press-fit protrusion 413 in the width direction, is positioned beyond the upper bent portion 440 in the first orientation. More specifically, the end portion 414 of the press-fit protrusion 413 of the upper front wide portion 412 is positioned in the first orientation beyond an edge 442, which faces the first orientation, of the upper bent portion 440.

Figure 7:
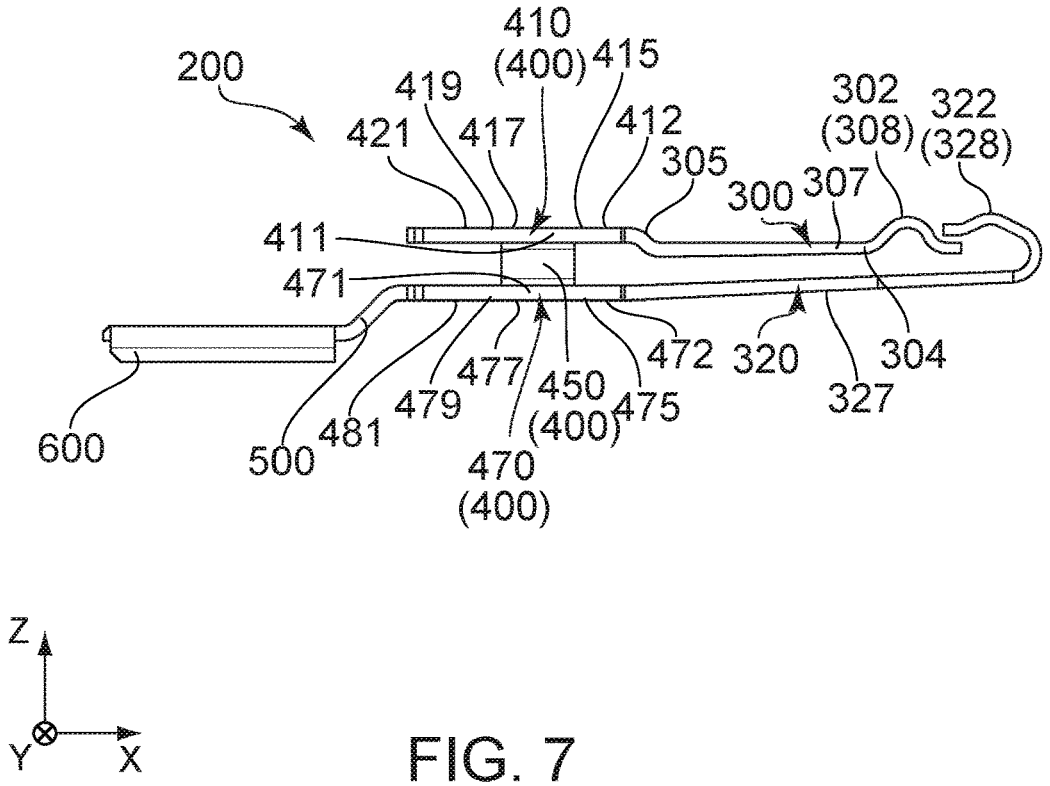
FIG. 7 is a side view showing the contact of FIG. 6.
Figure 9:
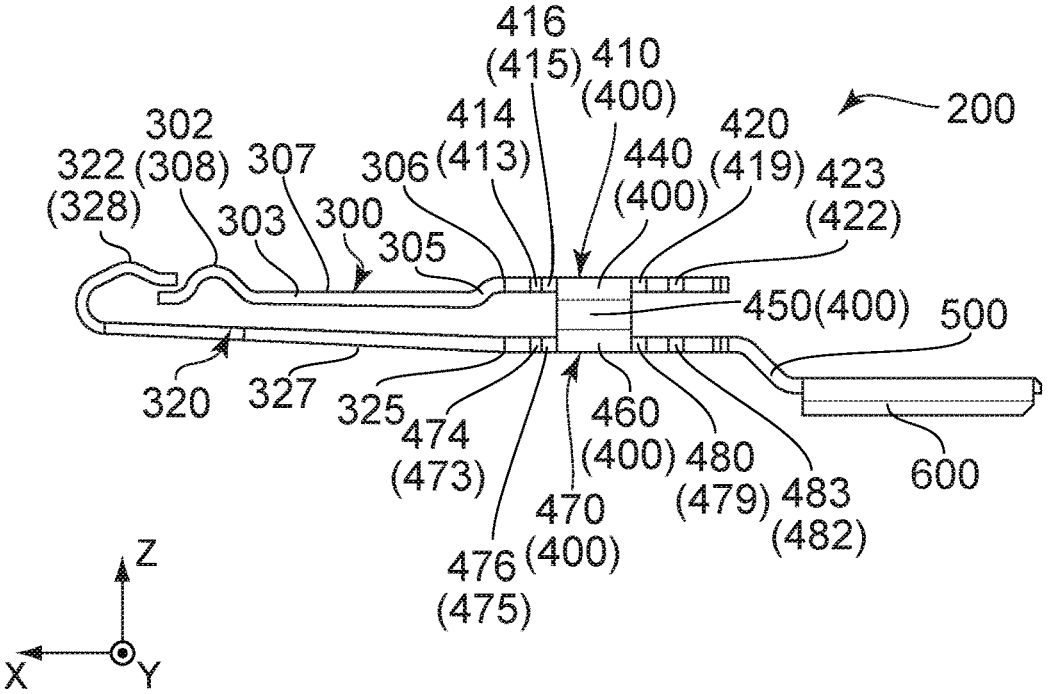
FIG. 9 is another side view showing the contact of FIG. 6.
Figure 10:
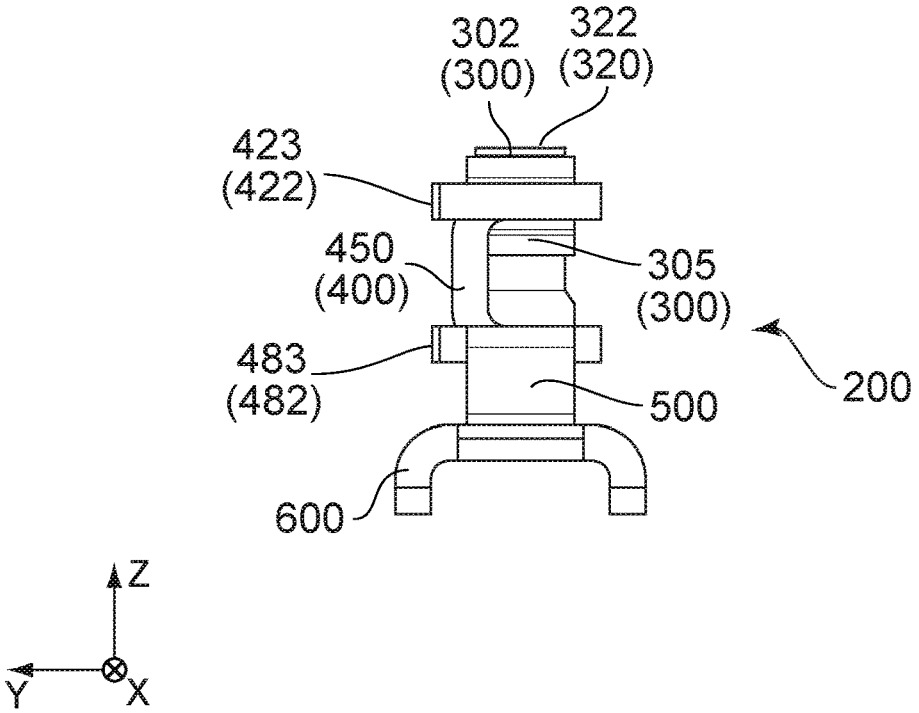
FIG. 10 is a rear view showing the contact of FIG. 6.

As shown in FIGS. 6, 7 and 9, the lower main portion 470 has a lower front wide portion 472, a lower front narrow portion 475 and a lower base portion 477.

As shown in FIGS. 6, 7 and 9, the lower main portion 470 has a plate-like shape perpendicular to the up-down direction. The lower main portion 470 has an edge 471 facing the second orientation, and the edge 471 has a linear shape.

As shown in FIGS. 6, 8 and 9, the lower front wide portion 472 has a press-fit protrusion 473 which protrudes in the first orientation of the width direction. As understood from FIG. 5, the lower front wide portion 472 is fixed to the holding member 700 so as to be immovable in the width direction. A specific method of fixing the lower front wide portion 472 to the holding member 700 will be described later. In the lower front wide portion 472, an end of the press-fit protrusion 473 in the width direction is an end portion 474 facing the first orientation.

As shown in FIG. 7, the second support portion 320 extends forward from the lower front wide portion 472 in the front-rear direction. More specifically, the second plate portion 327 of the second support portion 320 extends forward from a front end of the lower front wide portion 472.

As shown in FIG. 7, the lower front narrow portion 475 is positioned between the lower front wide portion 472 and the lower base portion 477 in the front-rear direction. More specifically, in the front-rear direction, the lower front narrow portion 475 is positioned rearward of the lower front wide portion 472 and forward of the lower base portion 477. In the width direction, the lower front narrow portion 475 has a size smaller than a size of the lower front wide portion 472. As understood from FIGS. 6, 7 and 9, the lower front narrow portion 475 has an edge 476 facing the first orientation, and the edge 476 is positioned in the second orientation beyond a second boundary portion 325 between an edge 324, which faces the first orientation, of the second support portion 320 and the lower front wide portion 472 in the front-rear direction. Accordingly, the contact 200 as a whole can have a reduced size in the width direction while a base of the second support portion 320 has an increased size in the width direction.

As shown in FIG. 7, the lower base portion 477 is positioned rearward of the lower front narrow portion 475 in the front-rear direction. The lower base portion 477 has a plate-like shape perpendicular to the up-down direction. As shown in FIG. 6, the lower base portion 477 has an edge 478 facing the first orientation.

As understood from FIGS. 6 and 9, the lower bent portion 460 extends from the edge 478, which faces the first orientation, of the lower base portion 477 of the lower main portion 470, and is bent upward. Specifically, the lower bent portion 460 is bent upward while extending in the first orientation from the edge 478, which faces the first orientation, of the lower base portion 477. The end portion 474, which faces the first orientation, of the lower front wide portion 472, namely, the end of the press-fit protrusion 473 in the width direction, is positioned beyond the lower bent portion 460 in the first orientation. More specifically, the end portion 474 of the press-fit protrusion 473 of the lower front wide portion 472 is positioned in the first orientation beyond an edge 462, which faces the first orientation, of the lower bent portion 460.

As shown in FIGS. 6, 7, 9 and 10, the wall portion 450 has a plate-like shape perpendicular to the width direction and couples the upper bent portion 440 and the lower bent portion 460 with each other. More specifically, the wall portion 450 couples a lower end of the upper bent portion 440 and an upper end of the lower bent portion 460 with each other in the up-down direction. Although the wall portion 450 of the present embodiment is perpendicular to the width direction, the present invention is not limited thereto. The wall portion 450 may make an angle other than a right angle with the width direction, provided that the wall portion 450 intersects with the width direction.

As shown in FIGS. 6 to 9, the upper rear narrow portion 419 is positioned between the upper base portion 417 of the upper main portion 410 of the coupling portion 400 and the upper rear wide portion 421 in the front-rear direction. More specifically, in the front-rear direction, the upper rear narrow portion 419 is positioned rearward of the upper base portion 417 and forward of the upper rear wide portion 421. In the width direction, the upper rear narrow portion 419 has a size smaller than a size of the upper rear wide portion 421.

As shown in FIGS. 6 to 9, the upper rear narrow portion 419 has an edge 420 facing the first orientation, and the edge 420 is positioned in the second orientation beyond the first boundary portion 306 between the first edge 303 of the first support portion 300 and the upper front wide portion 412.

As shown in FIGS. 6 and 9, the upper rear wide portion 421 is positioned rearward of the upper rear narrow portion 419 in the front-rear direction. The upper rear wide portion 421 has a press-fit protrusion 422 which protrudes in the first orientation of the width direction. As understood from FIGS. 4 and 6, the upper rear wide portion 421 is fixed to the holding member 700 so as to be immovable in the width direction. A specific method of fixing the upper rear wide portion 421 to the holding member 700 will be described later. In the upper rear wide portion 421, an end of the press-fit protrusion 422 in the width direction is an end portion 423 facing the first orientation. The end portion 423, which faces the first orientation, of the upper rear wide portion 421 is positioned beyond the upper bent portion 440 in the first orientation. More specifically, the end portion 423 of the press-fit protrusion 422 of the upper rear wide portion 421 is positioned in the first orientation beyond the edge 442, which faces the first orientation, of the upper bent portion 440.

As shown in FIGS. 6 to 9, in the contact 200 of the present embodiment, the upper main portion 410 of the coupling portion 400, the upper rear narrow portion 419 and the upper rear wide portion 421 are positioned in the same plane perpendicular to the up-down direction.

As shown in FIG. 7, the lower rear narrow portion 479 is positioned between the lower base portion 477 of the lower main portion 470 of the coupling portion 400 and the lower rear wide portion 481 in the front-rear direction. More specifically, in the front-rear direction, the lower rear narrow portion 479 is positioned rearward of the lower base portion 477 and forward of the lower rear wide portion 481. In the width direction, the lower rear narrow portion 479 has a size smaller than a size of the lower rear wide portion 481. The lower rear narrow portion 479 has an edge 480 facing the first orientation, and the edge 480 is positioned in the second orientation beyond the second boundary portion 325 between the edge 324, which faces the first orientation, of the second support portion 320 and the lower front wide portion 472.

As shown in FIG. 7, the lower rear wide portion 481 is positioned rearward of the lower rear narrow portion 479 in the front-rear direction. As shown in FIGS. 6 and 9, the lower rear wide portion 481 has a press-fit protrusion 482 which protrudes in the first orientation of the width direction. As understood from FIG. 5, the lower rear wide portion 481 is fixed to the holding member 700 so as to be immovable in the width direction. A specific method of fixing the lower rear wide portion 481 to the holding member 700 will be described later. In the lower rear wide portion 481, an end of the press-fit protrusion 482 in the width direction is an end portion 483 facing the first orientation. The end portion 483, which faces the first orientation, of the lower rear wide portion 481 is positioned beyond the lower bent portion 460 in the first orientation. More specifically, as shown in FIG. 6, the end portion 483 of the press-fit protrusion 482 of the lower rear wide portion 481 is positioned in the first orientation beyond the edge 462, which faces the first orientation, of the lower bent portion 460.

As shown in FIG. 7, in the contact 200 of the present embodiment, the lower main portion 470 of the coupling portion 400, the lower rear narrow portion 479 and the lower rear wide portion 481 are positioned in the same plane perpendicular to the up-down direction.

As shown in FIGS. 6 to 10, the connecting portion 500 extends rearward and downward from a rear end of the lower rear wide portion 481. A rear end of the connecting portion 500 is connected with a front end of the fixed portion 600. The fixed portion 600 is connected with a cable (not shown) when used.

As shown in FIGS. 2 to 5, the contacts 200 are held by the holding member 700 so as to be arranged in two rows. The contacts 200 of each row are arranged in the width direction. The two rows are arranged in the up-down direction and include an upper row and a lower row which is positioned below the upper row. The contacts 200 of the upper row correspond to the mating upper contacts 810, respectively. The contacts 200 of the lower row correspond to the mating lower contacts 820, respectively. More specifically, each of the contacts 200 of the present embodiment is inserted forward from a rear end of the holding member 700 to be press-fit into the corresponding contact holding portion 720. As understood from FIG. 5, each of the contacts 200 of the upper row is turned upside down and is press-fit into the corresponding contact holding portion 720. Meanwhile, each of the press-fit protrusions 413, 422, 473 and 482 of the contact 200 bites into one of the inner walls, which face each other in the width direction, of the corresponding contact holding portion 720. Also meanwhile, the edge 411 of the upper main portion 410 of the contact 200 is brought into contact with a remaining one of the inner walls, which face each other in the width direction, of the corresponding contact holding portion 720. Since the edge 411 of the upper main portion 410 has the linear shape as described above, each of the contacts 200 can be properly aligned in the corresponding contact holding portion 720. Moreover, meanwhile, a bottom surface of the second support portion 320 of the contact 200 is not brought into contact with the holding member 700.

As understood from FIGS. 2 to 5 and 26, when the connector body 110 of the connector 100 of the present embodiment is mated with the mating connector 800, the first contact portion 302 of the first support portion 300 and the second contact portion 322 of the second support portion 320 of each of the contacts 200 of the upper row of the connector body 110 are brought into contact with the corresponding mating upper contact 810 of the mating connector 800 while the first contact portion 302 of the first support portion 300 and the second contact portion 322 of the second support portion 320 of each of the contacts 200 of the lower row of the connector body 110 are brought into contact with the corresponding mating lower contact 820 of the mating connector 800. Meanwhile, the free end of the bulge portion 308 of the first support portion 300 and the free end of the folded back portion 328 of the second support portion 320 are not brought into contact with each other. Specifically, when the connector 100 and the mating connector 800 are mated with each other, both of the first contact portion 302 and the second contact portion 322 of each of the contacts 200 of the upper row are simultaneously brought into contact with the corresponding mating upper contact 810 while both of the first contact portion 302 and the second contact portion 322 of each of the contacts 200 of the lower row are simultaneously brought into contact with the corresponding mating lower contact 820. Accordingly, when the connector 100 and the mating connector 800 are mated with each other, each of the contacts 200 of the upper row is securely and stably in contact with the corresponding mating upper contact 810 while each of the contacts 200 of the lower row is securely and stably in contact with the corresponding mating lower contact 820.

The structure of the contact 200 is not limited thereto. For example, the contact 200 can be modified as described below.

Referring to FIGS. 11 to 14, each of contacts 200A and 200B according to modifications of the first embodiment has a structure substantially same as that of the contact 200 (see FIG. 8) according to the aforementioned first embodiment. Accordingly, components of the contact 200A, 200B shown in FIGS. 11 to 14 which are same as those of the contact 200 of the first embodiment are referred by using reference signs same as those of the contact 200 of the first embodiment.

Figure 11:
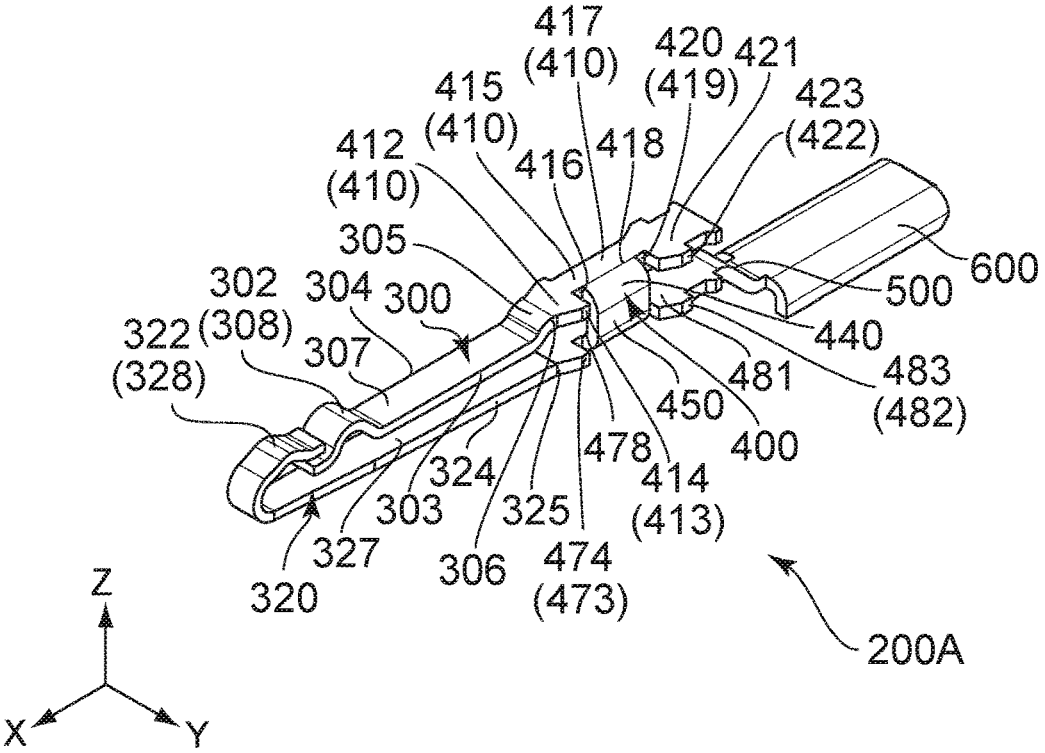
FIG. 11 is an upper perspective view showing a modification of the contact of FIG. 6.
Figure 12:
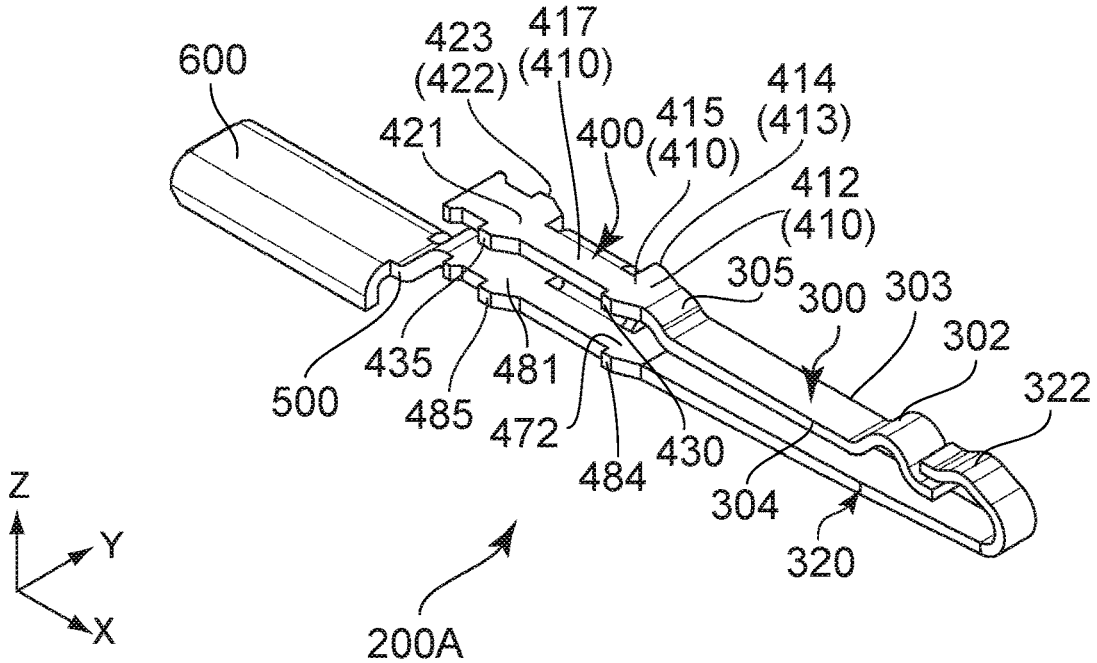
FIG. 12 is another upper perspective view showing the contact of FIG. 11.

As shown in FIGS. 11 and 12, dissimilar to the contact 200 of the first embodiment, the contact 200A according to a modification has press-fit protrusions 413, 430, 422, 435, 473, 484, 482 and 485. The press-fit protrusions 413 and 430 protrude outward from opposite ends, respectively, of an upper front wide portion 412 in the width direction. The press-fit protrusions 422 and 435 protrude outward from opposite ends, respectively, of an upper rear wide portion 421 in the width direction. The press-fit protrusions 473 and 484 protrude outward from opposite ends, respectively, of a lower front wide portion 472 in the width direction. The press-fit protrusions 482 and 485 protrude outward from opposite ends, respectively, of a lower rear wide portion 481 in the width direction. Accordingly, the contact 200A is firmly held by the holding member 700.

Figure 13:
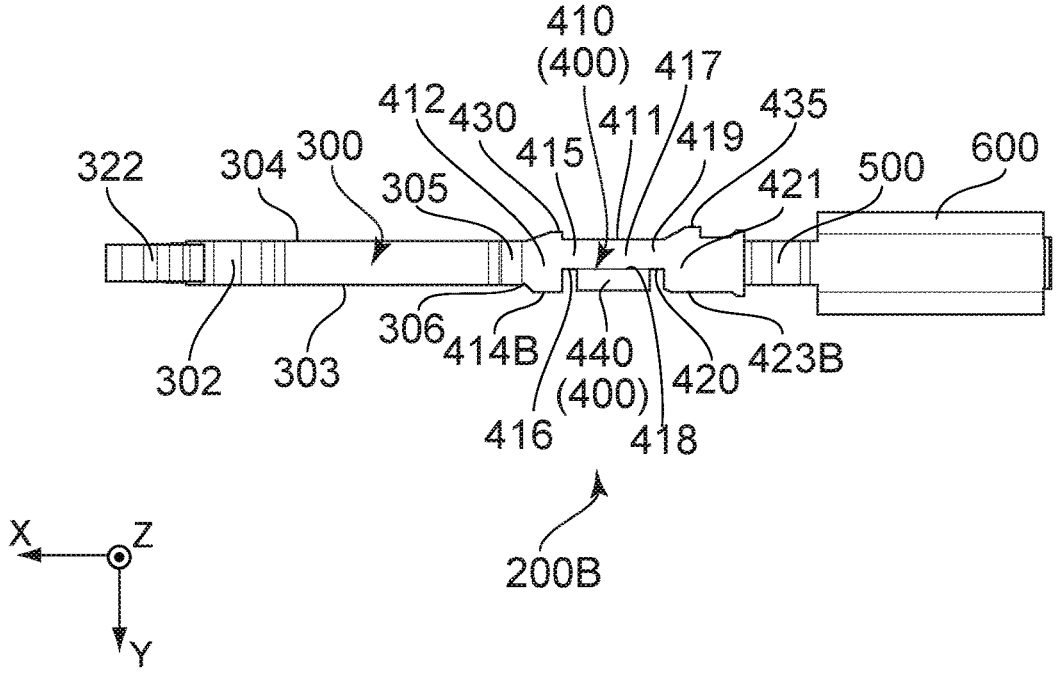
FIG. 13 is a top view showing another modification of the contact of FIG. 6.
Figure 14:
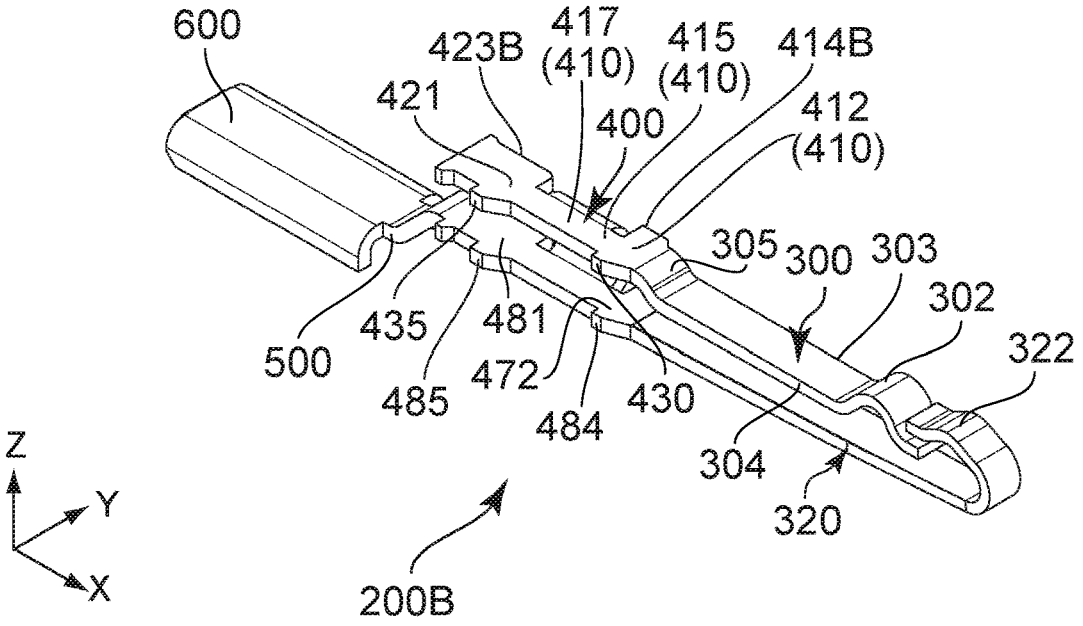
FIG. 14 is an upper perspective view showing the contact of FIG. 13.

As shown in FIGS. 13 and 14, dissimilar to the contact 200 of the first embodiment, the contact 200B of another modification has press-fit protrusions 430, 435, 484 and 485. The press-fit protrusion 430 protrudes from an upper front wide portion 412 in the second orientation. The press-fit protrusion 435 protrudes from an upper rear wide portion 421 in the second orientation. The press-fit protrusion 484 protrudes from a lower front wide portion 472 in the second orientation. The press-fit protrusion 485 protrudes from a lower rear wide portion 481 in the second orientation. Since the upper front wide portion 412 is firmly fixed to the holding member 700 also in the present modification, stress, which arises when a first support portion 300 is resiliently deformed in the up-down direction, is concentrated on a boundary portion between a second edge 304 of the first support portion 300 and the upper front wide portion 412. Accordingly, the stress can be prevented from being concentrated on an upper front narrow portion 415 having a reduced size in the width direction. In the present modification, an end portion 414B, which faces the first orientation, of the upper front wide portion 412 is positioned beyond an upper bent portion 440 in the first orientation, and an end portion 423B, which faces the first orientation, of the upper rear wide portion 421 is positioned beyond the upper bent portion 440 in the first orientation. Similarly, each of an end portion (not shown), which faces the first orientation, of the lower front wide portion 472 and an end portion (not shown), which faces the first orientation, of the lower rear wide portion 481 is positioned beyond a lower bent portion 460 in the first orientation.

Second Embodiment

Figure 15:
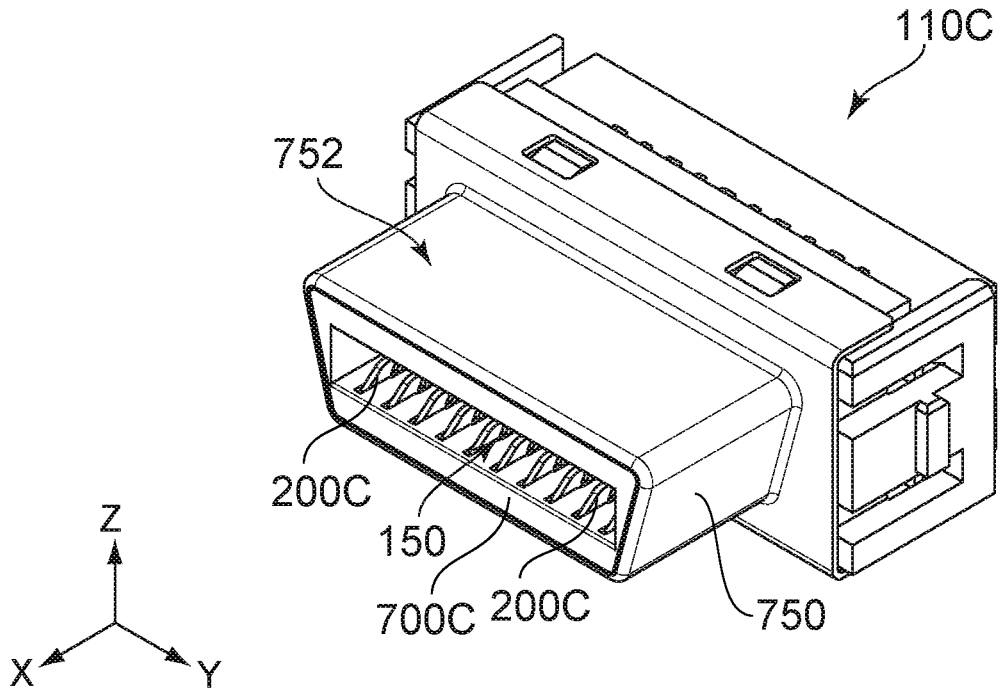
FIG. 15 is an upper perspective view showing a connector body which is included in a connector according to a second embodiment of the present invention.

Referring to FIGS. 1, 2 and 15, a connector (not shown) according to a second embodiment of the present invention comprises a connector body 110C instead of the connector body 110 (see FIG. 2) in the connector 100 (see FIG. 1) of the first embodiment. The connector body 110C according to the present embodiment has a structure substantially same as that of the connector body 110 (see FIG. 2) according to the aforementioned first embodiment. Accordingly, components of the connector body 110C shown in FIGS. 15 to 18 which are same as those of the connector body 110 of the first embodiment are referred by using reference signs same as those of the connector body 110 of the first embodiment. As for directions in the present embodiment, expressions same as those of the first embodiment will be used hereinbelow.

As shown in FIGS. 15 to 18, the connector body 110C has an opening 150, a holding member 700C, a plurality of contacts 200C and a shell 750.

As shown in FIGS. 15 to 18, the holding member 700C of the present embodiment has a receiving portion 710 and a plurality of contact holding portions 720C. The receiving portion 710 receives the plate portion 805 of the mating connector 800 when the connector (not shown) of the present embodiment and the mating connector 800 are mated with each other. The receiving portion 710 has a rear wall 715C which is positioned rearwardly away from the opening 150 in the front-rear direction. The contact holding portions 720C hold the contacts 200C, respectively. Each of the contact holding portions 720C is a hole which pierces the holding member 700C in the front-rear direction. Each of the contact holding portions 720C has two inner walls which face each other in the width direction.

As shown in FIGS. 19 to 23, each of the contacts 200C has a first support portion 300C, a second support portion 320C, a first contact portion 302C, a second contact portion 322C, a coupling portion 400C, an upper rear wide portion 421C, an upper rear narrow portion 419C, a connecting portion 500C and a fixed portion 600C.

As shown in FIGS. 19 to 23, the first support portion 300C has a slope portion 305C, a first plate portion 307C and a bulge portion 308C. The slope portion 305C is positioned at a rear end of the first support portion 300C in the front-rear direction. The slope portion 305C slopes forward and downward. The first plate portion 307C has a plate-like shape intersecting with the up-down direction. The first plate portion 307C extends forward and upward from a front end of the slope portion 305C. The bulge portion 308C extends forward and upward from a front end of the first plate portion 307C and then extends forward and downward. Specifically, a front end of the bulge portion 308C is a free end. More specifically, the bulge portion 308C has a substantially semicircular shape in a plane perpendicular to the width direction. The first contact portion 302C is positioned at an upper end of the bulge portion 308C.

As shown in FIGS. 19 to 22, the first support portion 300C has a first edge 303C and a second edge 304C in the width direction. The first edge 303C faces a first orientation of the width direction, and the second edge 304C faces a second orientation of the width direction. In the present embodiment, the first orientation is the negative Y-direction, and the second orientation is the positive Y-direction. In other words, the first orientation and the second orientation are opposite to each other.

Figure 16:
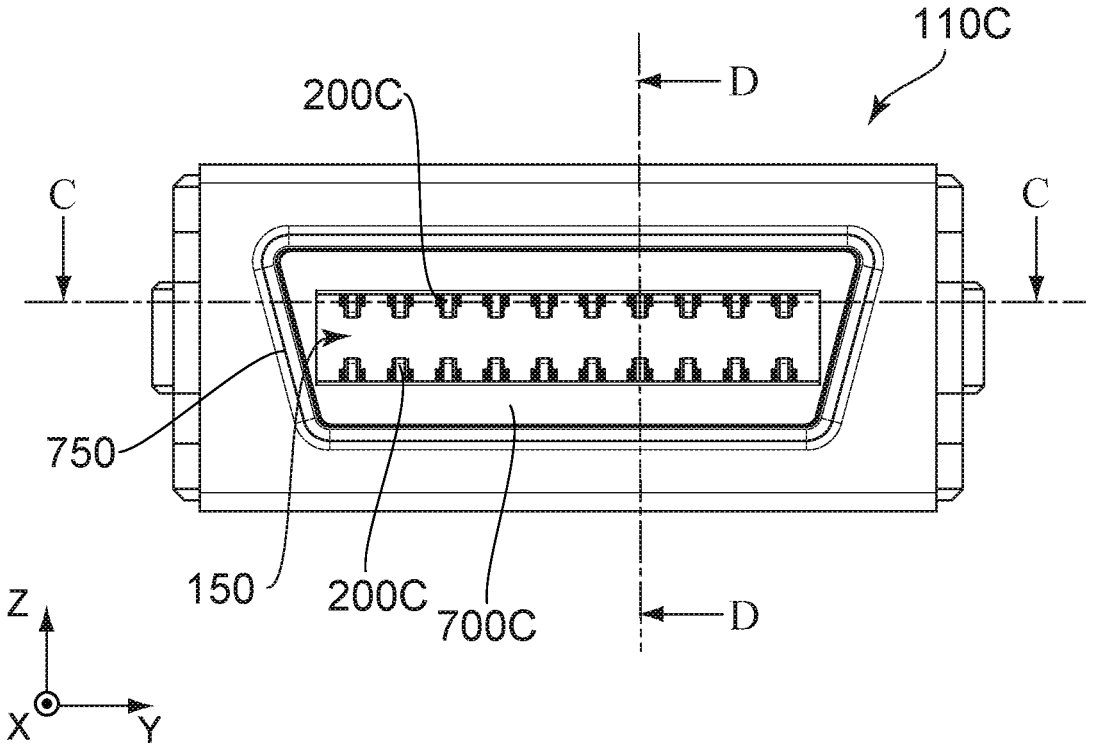
FIG. 16 is a front view showing the connector body of FIG. 15.
Figure 18:
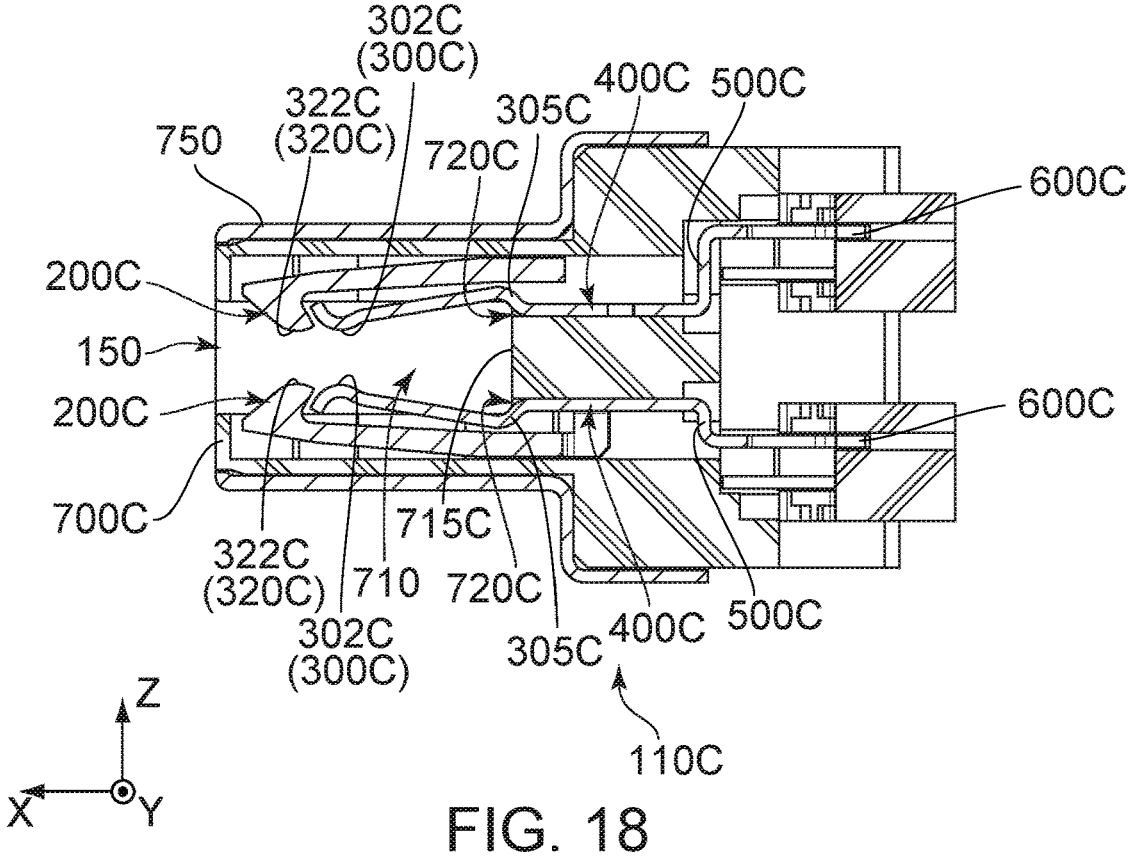
FIG. 18 is a cross-sectional view showing the connector body of FIG. 16, taken along line D-D.
Figure 19:
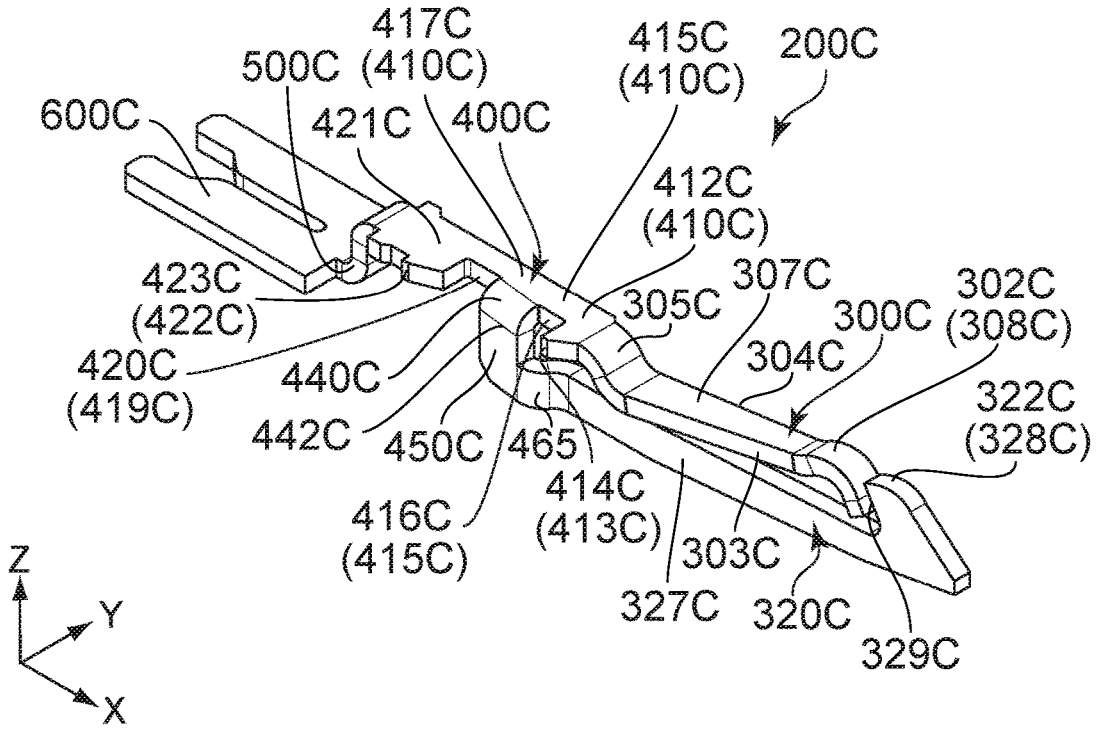
FIG. 19 is an upper perspective view showing a contact which is included in the connector body of FIG. 16.

As understood from FIGS. 16, 18 and 19, the first support portion 300C is resiliently deformable. The first contact portion 302C is positioned in the vicinity of the free end of the bulge portion 308C of the first support portion 300C. The first contact portion 302C is supported by the first support portion 300C. Accordingly, the first contact portion 302C is movable in the up-down direction perpendicular to the front-rear direction. More specifically, the first contact portion 302C of the first support portion 300C of the contact 200C shown in each of FIGS. 19 to 23 faces upward in the up-down direction and is movable downward.

As shown in FIGS. 19 to 23, the first support portion 300C has a size in the width direction and another size in the up-down direction, and the size of the first support portion 300C in the width direction is greater that the size of the first support portion 300C in the up-down direction. More specifically, the first plate portion 307C of the first support portion 300C has a size in the width direction and another size in the up-down direction, and the size of the first plate portion 307C in the width direction is greater that the size of the first plate portion 307C in the up-down direction.

Figure 20:
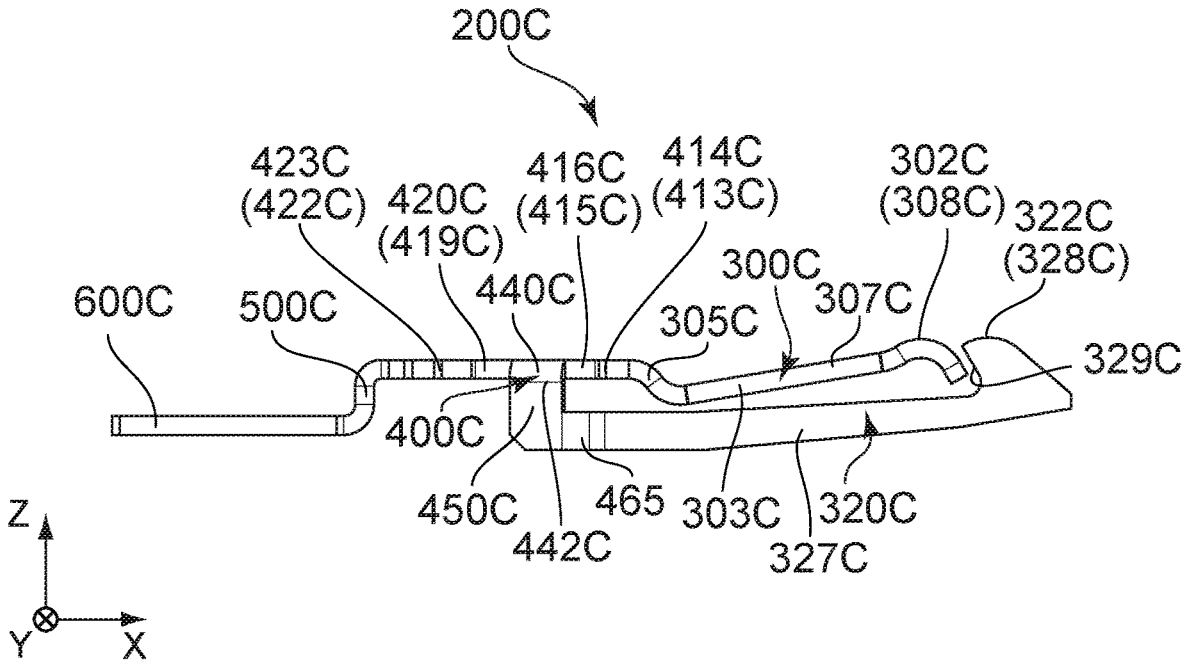
FIG. 20 is a side view showing the contact of FIG. 19.
Figure 22:
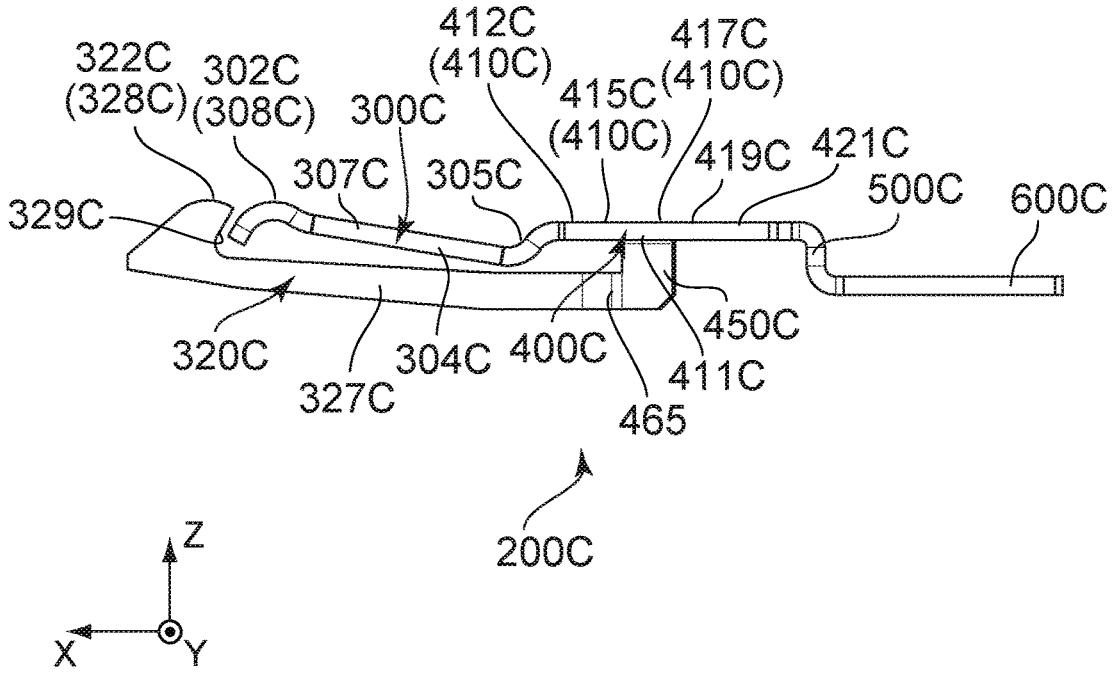
FIG. 22 is another side view showing the contact of FIG. 19.
Figure 23:
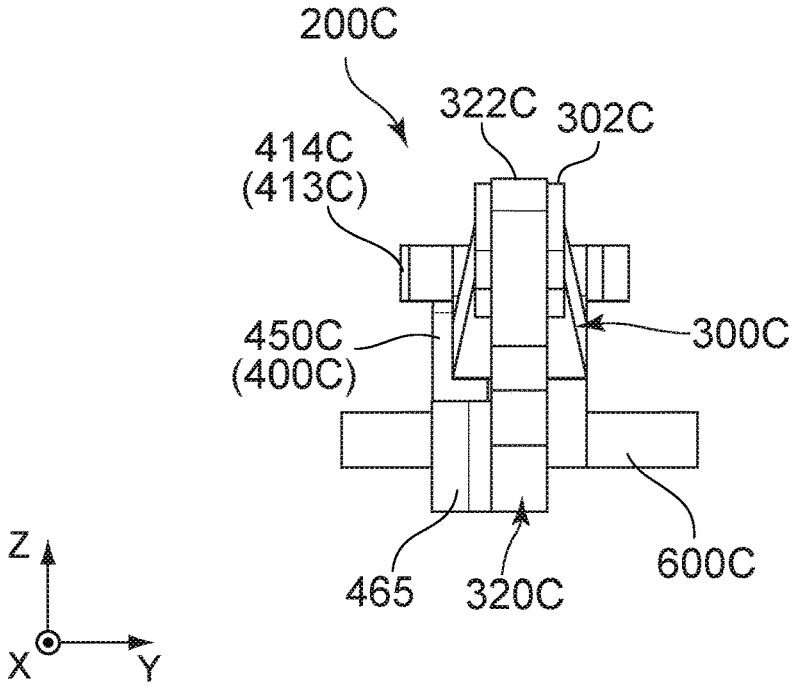
FIG. 23 is a front view showing the contact of FIG. 19.

As shown in FIGS. 19, 20 and 22, the second support portion 320C has a second plate portion 327C and a folded back portion 328C. The second plate portion 327C has a plate-like shape perpendicular to the width direction. The folded back portion 328C extends rearward and upward from a front end of the second plate portion 327C. The folded back portion 328C has a rear edge 329C intersecting with both the front-rear direction and the up-down direction. Specifically, the second support portion 320C has a half arrow shape when viewed in the width direction. The second contact portion 322C is positioned at an upper end of the folded back portion 328C.

As shown in FIGS. 19 to 23, the second support portion 320C has a size in the width direction and another size in the up-down direction, and the size of the second support portion 320C in the width direction is smaller than the size of the second support portion 320C in the up-down direction. More specifically, the second plate portion 327C of the second support portion 320C has a size in the width direction and another size in the up-down direction, and the size of the second plate portion 327C in the width direction is smaller than the size of the second plate portion 327C in the up-down direction. The second plate portion 327C of the second support portion 320C is positioned below the first support portion 300C in the up-down direction.

As understood from FIGS. 16, 18 and 19, the second support portion 320C is resiliently deformable. In addition, the second contact portion 322C is supported by the second support portion 320C. Accordingly, the second contact portion 322C is movable in the up-down direction. More specifically, in FIGS. 19 to 23, the illustrated second contact portion 322C of the second support portion 320C of the contact 200C faces upward in the up-down direction and is movable downward.

As shown in FIGS. 19 to 22, an upper end of the rear edge 329C of the folded back portion 328C of the second support portion 320C is positioned above the free end of the bulge portion 308C of the first support portion 300 in the up-down direction. The free end of the bulge portion 308C of the first support portion 300C is positioned rearward of the rear edge 329C of the folded back portion 328C of the second support portion 320C, so that the free end of the bulge portion 308C of the first support portion 300C is guarded by the rear edge 329C. Accordingly, the first support portion 300C is prevented from being buckled by unintended force which is applied to the free end of the bulge portion 308C of the first support portion 300C from its front side.

As shown in FIGS. 19, 20 and 22, the coupling portion 400C couples the first support portion 300C and the second support portion 320C with each other in the up-down direction. The coupling portion 400C has an upper main portion 410C, an upper bent portion 440C, a wall portion 450C and a curved portion 465.

As shown in FIGS. 19 to 22, the upper main portion 410C has an upper front wide portion 412C, an upper front narrow portion 415C and an upper base portion 417C.

As shown in FIGS. 19 to 22, the upper main portion 410C has a plate-like shape. The upper main portion 410C has an edge 411C facing the second orientation, and the edge 411C has a linear shape.

Figure 17:
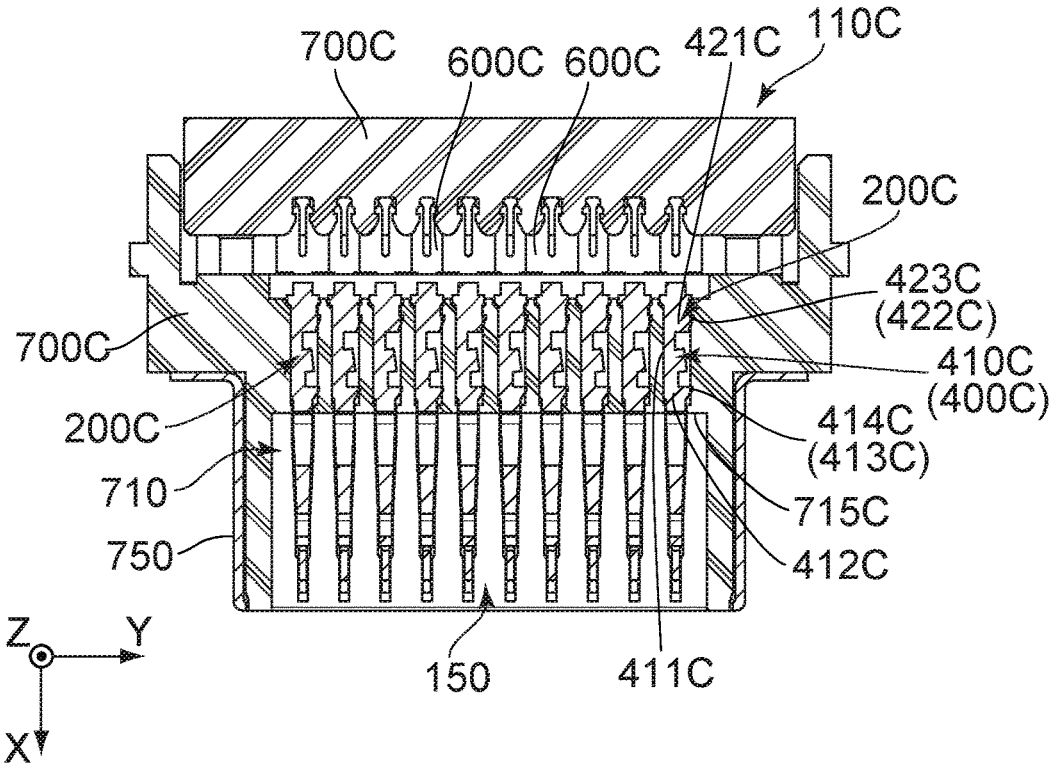
FIG. 17 is a cross-sectional view showing the connector body of FIG. 16, taken along line C-C.
Figure 21:
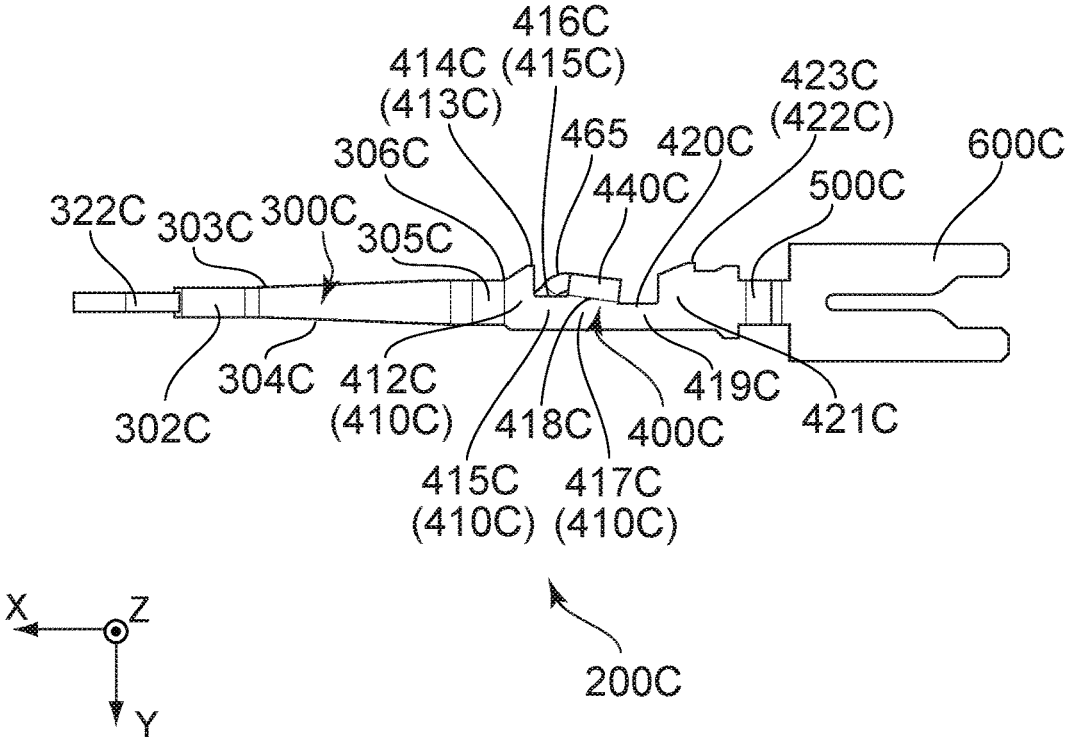
FIG. 21 is a top view showing the contact of FIG. 19.

As shown in FIGS. 19 to 21, the upper front wide portion 412C has a press-fit protrusion 413C which protrudes in the first orientation of the width direction. As shown in FIG. 17, the upper front wide portion 412C is fixed to the holding member 700C so as to be immovable in the width direction. A specific method of fixing the upper front wide portion 412C to the holding member 700C will be described later. In the upper front wide portion 412C, an end of the press-fit protrusion 413C in the width direction is an end portion 414C facing the first orientation.

As shown in FIGS. 19 to 22, the first support portion 300C extends forward from the upper front wide portion 412C in the front-rear direction. More specifically, the slope portion 305C of the first support portion 300C extends forward and downward from a front end of the upper front wide portion 412C.

As shown in FIGS. 19 to 22, the upper front narrow portion 415C is positioned between the upper front wide portion 412C and the upper base portion 417C in the front-rear direction. More specifically, in the front-rear direction, the upper front narrow portion 415C is positioned rearward of the upper front wide portion 412C and forward of the upper base portion 417C. In the width direction, the upper front narrow portion 415C has a size smaller than a size of the upper front wide portion 412C. Since the upper front wide portion 412C is fixed to the holding member 700C as described above, stress, which arises when the first support portion 300C is resiliently deformed in the up-down direction, is concentrated on a first boundary portion 306C between the first edge 303C of the first support portion 300C and the upper front wide portion 412C in the front-rear direction. Accordingly, the stress can be prevented from being concentrated on the upper front narrow portion 415C having a reduced size in the width direction.

As shown in FIG. 21, the upper front narrow portion 415C has an edge 416C facing the first orientation, and the edge 416C is positioned beyond the first boundary portion 306C in the second orientation. Accordingly, the contact 200C as a whole can have a reduced size in the width direction while a base of the first support portion 300C has an increased size in the width direction.

As shown in FIGS. 19 to 22, the upper base portion 417C is positioned rearward of the upper front narrow portion 415C in the front-rear direction. The upper base portion 417C has a plate-like shape perpendicular to the up-down direction. The upper base portion 417C has an edge 418C facing the first orientation. The edge 418C of the present embodiment intersects with both the front-rear direction and the width direction.

As shown in FIGS. 19 to 21, the upper bent portion 440C extends from the edge 418C, which faces the first orientation, of the upper base portion 417C, and is bent downward. Specifically, the upper bent portion 4400 is bent downward while extending in the first orientation and rearward from the edge 418C, which faces the first orientation, of the upper base portion 417C. The end portion 414C, which faces the first orientation, of the upper front wide portion 412C, namely, the end of the press-fit protrusion 413C in the width direction, is positioned beyond the upper bent portion 440C in the first orientation. More specifically, the end portion 414C of the press-fit protrusion 413C of the upper front wide portion 412C is positioned in the first orientation beyond an edge 442C, which faces the first orientation, of the upper bent portion 440C.

As shown in FIGS. 19 and 20, the wall portion 450C has a plate-like shape intersecting with both the front-rear direction and the width direction, and extends downward from a lower end of the upper bent portion 440C.

As shown in FIGS. 19 to 22, the curved portion 465 extends forward and in the second orientation from a lower part of a front end of the wall portion 450C. The second support portion 320C extends forward from a front end of the curved portion 465.

As shown in FIGS. 19 to 22, the upper rear narrow portion 419C is positioned between the upper base portion 417C of the upper main portion 410C of the coupling portion 400C and the upper rear wide portion 421C in the front-rear direction. More specifically, in the front-rear direction, the upper rear narrow portion 419C is positioned rearward of the upper base portion 417C and forward of the upper rear wide portion 421C. In the width direction, the upper rear narrow portion 419C has a size smaller than a size of the upper rear wide portion 421C.

As shown in FIG. 21, the upper rear narrow portion 419C has an edge 420C facing the first orientation, and the edge 420C is positioned in the second orientation beyond the first boundary portion 306C between the first edge 303C of the first support portion 300C and the upper front wide portion 412C.

As shown in FIGS. 19 to 22, the upper rear wide portion 421C is positioned rearward of the upper rear narrow portion 419C in the front-rear direction. The upper rear wide portion 421C has a press-fit protrusion 422C which protrudes in the first orientation of the width direction. As shown in FIG. 17, the upper rear wide portion 421C is fixed to the holding member 700C so as to be immovable in the width direction. A specific method of fixing the upper rear wide portion 421C to the holding member 700C will be described later. In the upper rear wide portion 421C, an end of the press-fit protrusion 422C in the width direction is an end portion 423C facing the first orientation. The end portion 423C, which faces the first orientation, of the upper rear wide portion 421C is positioned beyond the upper bent portion 440C in the first orientation. More specifically, the end portion 423C of the press-fit protrusion 422C of the upper rear wide portion 421C is positioned in the first orientation beyond the edge 442C, which faces the first orientation, of the upper bent portion 440C.

As shown in FIGS. 19 to 22, in the contact 200C of the present embodiment, the upper main portion 410C of the coupling portion 400C, the upper rear narrow portion 419C and the upper rear wide portion 421C are positioned in the same plane perpendicular to the up-down direction.

As shown in FIGS. 19 to 22, the connecting portion 500C extends rearward and downward from a rear end of the upper rear wide portion 421C. A rear end of the connecting portion 500C is connected with a front end of the fixed portion 600C. The fixed portion 600C is connected with a cable (not shown) when used.

As shown in FIGS. 16 to 18, the contacts 200C are held by the holding member 700C so as to be arranged in two rows. The contacts 200C of each row are arranged in the width direction. The two rows are arranged in the up-down direction and include an upper row and a lower row which is positioned below the upper row. The contacts 200C of the upper row correspond to the mating upper contacts 810, respectively. The contacts 200C of the lower row correspond to the mating lower contacts 820, respectively. More specifically, each of the contacts 200C of the present embodiment is inserted forward from a rear end of the holding member 700C to be press-fit into the corresponding contact holding portion 720C. As understood from FIG. 18, each of the contacts 200C of the upper row is turned upside down and is press-fit into the corresponding contact holding portion 720C. Meanwhile, each of the press-fit protrusions 413C and 422C of the contact 200C bites into one of the inner walls, which face each other in the width direction, of the corresponding contact holding portion 720C. Also meanwhile, the edge 411C of the upper main portion 410C of the contact 200C is brought into contact with a remaining one of the inner walls, which face each other in the width direction, of the corresponding contact holding portion 720C. Since the edge 411C of the upper main portion 410C has the linear shape as described above, each of the contacts 200C can be properly aligned in the corresponding contact holding portion 720C.

As shown in FIGS. 15 to 18 and 26, when the connector body 110C of the connector 100C of the present embodiment is mated with the mating connector 800, the first contact portion 302C of the first support portion 300C and the second contact portion 322C of the second support portion 320C of each of the contacts 200C of the upper row of the connector body 110C are brought into contact with the corresponding mating upper contact 810 of the mating connector 800 while the first contact portion 302C of the first support portion 300C and the second contact portion 322C of the second support portion 320C of each of the contacts 200C of the lower row of the connector body 110C are brought into contact with the corresponding mating lower contact 820 of the mating connector 800. Meanwhile, the free end of the bulge portion 308C of the first support portion 300C and the rear edge 329C of the folded back portion 328C of the second support portion 320C are not brought into contact with each other. Specifically, when the connector 100C and the mating connector 800 are mated with each other, both of the first contact portion 302C and the second contact portion 322C of each of the contacts 200C of the upper row are simultaneously brought into contact with the corresponding mating upper contact 810 while both of the first contact portion 302C and the second contact portion 322C of each of the contacts 200C of the lower row are simultaneously brought into contact with the corresponding mating lower contact 820. Accordingly, when the connector 100C and the mating connector 800 are mated with each other, each of the contacts 200C of the upper row is securely and stably in contact with the corresponding mating upper contact 810 while each of the contacts 200C of the lower row is securely and stably in contact with the corresponding mating lower contact 820.

The structure of the contact 200C is not limited thereto. For example, the contact 200C can be modified as described below.

Figure 24:
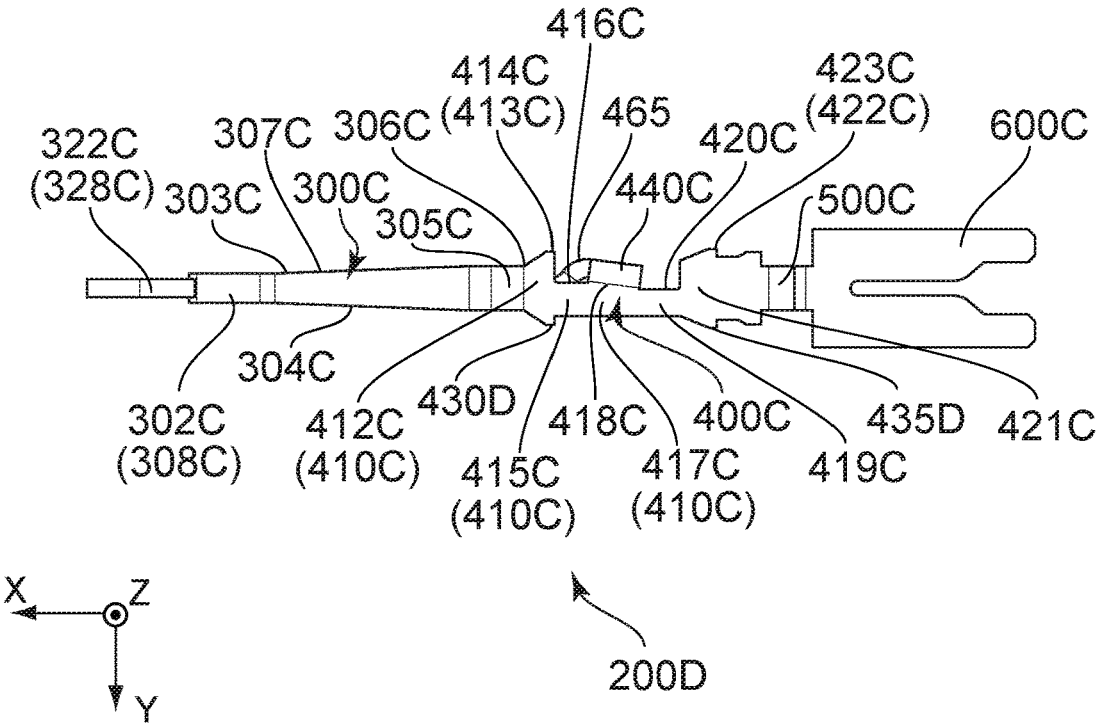
FIG. 24 is a top view showing a modification of the contact of FIG. 19.
Figure 25:
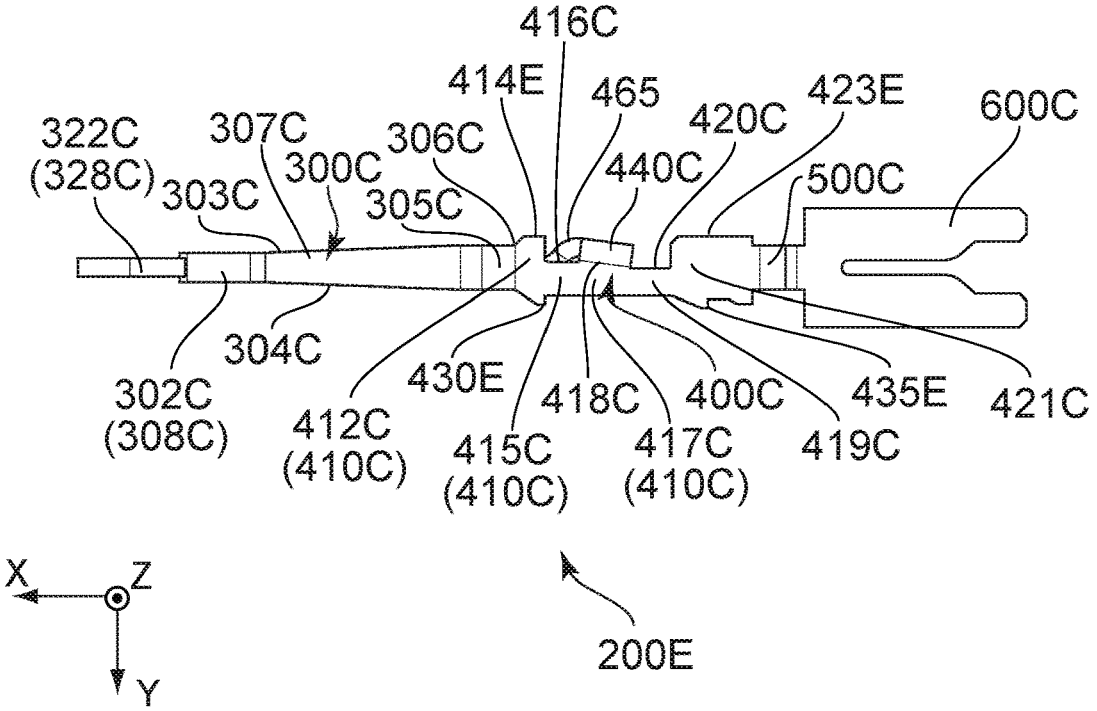
FIG. 25 is a top view showing another modification of the contact of FIG. 19.

Referring to FIGS. 24 and 25, each of contacts 200D and 200E according to modifications of the second embodiment of the present invention has a structure substantially same as that of the contact 200C (see FIG. 21) according to the aforementioned second embodiment. Accordingly, components of the contact 200D, 200E shown in FIGS. 24 and 25 which are same as those of the contact 200C of the second embodiment are referred by using reference signs same as those of the contact 200C of the second embodiment.

As shown in FIG. 24, dissimilar to the contact 200C of the second embodiment, the contact 200D according to a modification has press-fit protrusions 413C, 430D, 422C and 435D. The press-fit protrusions 413C and 430D protrude outward from opposite ends, respectively, of an upper front wide portion 412C in the width direction. The press-fit protrusions 422C and 435D protrude outward from opposite ends, respectively, of an upper rear wide portion 421C in the width direction. Accordingly, the contact 200D is firmly held by the holding member 700C.

As shown in FIG. 25, dissimilar to the contact 200C of the second embodiment, the contact 200E of another modification has press-fit protrusions 430E and 435E. The press-fit protrusion 430E protrudes in the second orientation from an upper front wide portion 412C. The press-fit protrusion 435E protrudes in the second orientation from an upper rear wide portion 421C. Since the upper front wide portion 412C is firmly fixed to the holding member 700C also in the present modification, stress, which arises when a first support portion 300C is resiliently deformed in the up-down direction, is concentrated on a boundary portion between a second edge 304C of the first support portion 300C and the upper front wide portion 412C. Accordingly, the stress can be prevented from being concentrated on an upper front narrow portion 415C having a reduced size in the width direction. In the present modification, an end portion 414E, which faces the first orientation, of the upper front wide portion 412C is positioned beyond an upper bent portion 440C in the first orientation, and an end portion 423E, which faces the first orientation, of the upper rear wide portion 421C is positioned beyond the upper bent portion 440C in the first orientation.

Although the specific explanation about the present invention is made above referring to the embodiments, the present invention is not limited thereto and is susceptible to various modifications and alternative forms.

Although the connector body 110, 110C of the aforementioned embodiment comprises a plurality of the contacts 200, 220C, the present invention is not limited thereto. The number of the contact 200, 200C of the connector body 110,110C may be one. In other words, the connector body 110, 110A may comprise at least one contact 200, 200C.

Although the press-fit protrusion is also provided on a part other than the upper front wide portion 412, 412C in the contact 200, 200A, 200B, 200C, 200D, 200E of the aforementioned embodiments, the present invention is not limited thereto. The press-fit protrusion may be provided only on the upper front wide portion 412, 412C.

Especially in the contact 200, 200A, 200B of the present embodiments, the lower front wide portion 472 is fixed to the holding member 700, and the bottom surface of the second support portion 320 is not brought into contact with the holding member 700. The lower front wide portion 472 may, however, not be fixed to the holding member 700, provided that the bottom surface of the second support portion 320 is brought into contact with and is received by the holding member 700.

Although the upper front wide portion 412, 412C of the contact 200, 200A, 200B, 200C, 200D, 200E of the present embodiments is fixed to the holding member 700, 700C by being press-fit thereinto, the present invention is not limited thereto. It is sufficient that the upper front wide portion 412, 412C is fixed to the holding member 700, 700C so as to be immovable in the width direction. For example, the upper front wide portion 412, 412C may be fixed thereto by insert molding.

In the contact 200, 200A, 200B, 200C, 200D, 200E of the present embodiments, the upper main portion 410, 410C, the upper rear narrow portion 419, 419C and the upper rear wide portion 421, 421C are positioned in the same plane perpendicular to the up-down direction. The upper main portion 410, 410C, the upper rear narrow portion 419, 419C and the upper rear wide portion 421, 421C may, however, not be positioned in the same plane perpendicular to the up-down direction. Specifically, there may be a step between the upper main portion 410, 410C and the upper rear narrow portion 419, 419C, and there may be a step between the upper rear narrow portion 419, 419C and the upper rear wide portion 421, 421C.

In the contact 200, 200A, 200B of the present embodiments, the lower main portion 470, the lower rear narrow portion 479 and the lower rear wide portion 481 are positioned in the same plane perpendicular to the up-down direction. The lower main portion 470, the lower rear narrow portion 479 and the lower rear wide portion 481 may, however, not be positioned in the same plane perpendicular to the up-down direction. Specifically, there may be a step between the lower main portion 470 and the lower rear narrow portion 479, and there may be a step between the lower rear narrow portion 479 and the lower rear wide portion 481.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a front-rear direction, wherein:

the connector comprises at least one contact and a holding member;

the holding member holds the at least one contact;

the at least one contact has a first support portion, a second support portion, a first contact portion, a second contact portion and a coupling portion;

each of the first support portion and the second support portion is resiliently deformable;

the first contact portion is supported by the first support portion;

the second contact portion is supported by the second support portion;

each of the first contact portion and the second contact portion is movable in an up-down direction perpendicular to the front-rear direction;

the first support portion has a first edge and a second edge in a width direction perpendicular to both the front-rear direction and the up-down direction;

the first edge faces a first orientation of the width direction;

the second edge faces a second orientation of the width direction;

the first orientation and the second orientation are opposite to each other in the width direction;

the coupling portion couples the first support portion and the second support portion with each other;

the coupling portion has an upper main portion and an upper bent portion;

the upper main portion has an upper front wide portion, an upper front narrow portion and an upper base portion;

the upper front wide portion is fixed to the holding member so as to be immovable in the width direction;

the first support portion extends forward from the upper front wide portion in the front-rear direction;

the upper front narrow portion is positioned between the upper front wide portion and the upper base portion in the front-rear direction;

the upper front narrow portion has an edge facing the first orientation;

the at least one contact has a first boundary portion between the first edge of the first support portion and the upper front wide portion in the front-rear direction;

the edge of the upper front narrow portion is positioned beyond the first boundary portion in the second orientation;

the upper base portion has an edge facing the first orientation;

the upper bent portion extends from the edge of the upper base portion and is bent downward;

the second support portion has a size in the width direction and another size in the up-down direction;

the size of the second support portion in the width direction is greater than the size of the second support portion in the up-down direction;

the second support portion is positioned below the first support portion in the up-down direction;

the coupling portion further has a lower main portion and a lower bent portion;

the lower main portion has a lower front wide portion, a lower front narrow portion and a lower base portion;

the second support portion extends forward from the lower front wide portion in the front-rear direction;

the lower front narrow portion is positioned between the lower front wide portion and the lower base portion in the front-rear direction;

in the width direction, the lower front narrow portion has a size smaller than a size of the lower front wide portion;

the lower front narrow portion has an edge facing the first orientation;

the second support portion has an edge facing the first orientation;

the at least one contact has a second boundary portion between the edge of the second support portion and the lower front wide portion in the front-rear direction;

the edge of the lower front narrow portion is positioned beyond the second boundary portion in the second orientation;

the lower base portion has an edge facing the first orientation; and the lower bent portion extends from the edge of the lower base portion and is bent upward.

2. The connector as recited in claim 1, wherein:

the first support portion has a size in the width direction and another size in the up-down direction;

the size of the first support portion in the width direction is greater than the size of the first support portion in the up-down direction;

the upper main portion has a flat plate shape;

the upper front wide portion of the upper main portion has a press-fit protrusion protruding in the width direction;

the upper front wide portion has an end portion facing the first orientation; and the end portion of the upper front wide portion is positioned beyond the upper bent portion in the first orientation.

3. The connector as recited in claim 1, wherein:

the at least one contact further has an upper rear wide portion and an upper rear narrow portion;

the upper rear wide portion is positioned rearward of the upper rear narrow portion in the front-rear direction;

the upper rear wide portion is fixed to the holding member so as to be immovable in the width direction;

the upper rear narrow portion is positioned between the upper base portion and the upper rear wide portion in the front-rear direction; and in the width direction, the upper rear narrow portion has a size smaller than a size of the upper rear wide portion.

4. The connector as recited in claim 3, wherein:

the upper rear wide portion has an end portion facing the first orientation; and the end portion of the upper rear wide portion is positioned beyond the upper bent portion in the first orientation.

5. The connector as recited in claim 1, wherein:

the upper main portion has an edge facing the second orientation; and the edge of the upper main portion has a linear shape.

6. The connector as recited in claim 1, wherein:

the coupling portion further has a wall portion having a flat plate shape;

the wall portion couples the upper bent portion and the lower bent portion with each other; and the wall portion intersects with the width direction.

* * * * *